US006139204A

United States Patent [19]

Ozaki

[11] Patent Number: 6,139,204

[45] Date of Patent: Oct. 31, 2000

[54] CLEANING DEVICE, CLEANING DEVICE FOR DEVELOPING PROCESSING APPARATUS, DRYING DEVICE, AND DRYING DEVICE FOR DEVELOPING PROCESSING APPARATUS

[75] Inventor: Takao Ozaki, Kanagawa, Japan

[73] Assignee: Fuji Photo Film Co., Ltd., Kanagawa, Japan

[21] Appl. No.: 09/041,738

[22] Filed: Mar. 13, 1998

[30] Foreign Application Priority Data

Mar. 27, 1997 [JP] Japan ..... 9-075849

[51] Int. Cl.[7] ..... G03D 13/00; G03D 5/00

[52] U.S. Cl. ..... 396/575; 396/604; 396/606

[58] Field of Search ..... 396/575, 604, 396/606, 572, 571, 631, 609; 250/316.1, 317.1, 318, 319; 219/216

[56] References Cited

U.S. PATENT DOCUMENTS

| | | | |
|---|---|---|---|
| 831,520 | 9/1906 | Pease | 396/604 |
| 3,060,829 | 10/1962 | Leighton et al. | 396/604 |
| 5,059,996 | 10/1991 | Bailey et al. | 396/604 |
| 5,109,246 | 4/1992 | Yamamoto et al. | 396/606 |
| 5,819,130 | 10/1998 | Inoue | 396/575 |

*Primary Examiner*—D. Rutledge

*Attorney, Agent, or Firm*—Sughrue, Mion, Zinn, Macpeak & Seas, PLLC

[57] ABSTRACT

According to the invention, only the surface where washing is necessary can be washed with a simple configuration, and a high humidity adhesion property of the heat developing photosensitive material after the heat developing processing can be eliminated regardless of the degree of the humidity. A pair of guiding rollers are provided above a water washing roller. The guiding rollers are provided such that the lowermost points are below the uppermost point of the water washing roller. The water washing roller rotates while rubbing the lower surface of a film. Washing water is taken out toward the transported film by the water washing roller by the high speed rotation thereof (400 rpm) so as to form a flow on the upstream side with respect to the contacting portion with the film at the uppermost point. The lower surface of the film is washed off by the flow which washes off salts having a high humidity adhesion property and the washing water taken out does not reach the downstream side of the water washing roller 216.

14 Claims, 19 Drawing Sheets

CLEANING DEVICE, CLEANING DEVICE FOR DEVELOPING PROCESSING APPARATUS, DRYING DEVICE, AND DRYING DEVICE FOR DEVELOPING PROCESSING APPARATUS

BACKGROUND OF THE INVENTION

1. Field of the Invention

The present invention relates to a cleaning device for cleaning at least one side of a sheet material, a silver halide photosensitive material where an image is exposed, a cleaning device used in a developing processing apparatus for forming an image on the silver halide photosensitive material by using a processing sheet containing a chemical, which is attached with the silver halide photosensitive material and applied with heat so as to form an image on the silver halide photosensitive material, and a drying device.

2. Description of the Related Art

Conventionally, a lith film (photosensitive material) has been used for printing newspapers or magazines. The lith film indicates the density of each picture element by the density of black dots (dot processing) . In the case of color printing, a film where the shade of each color is expressed is produced for obtaining a color image.

Since an image is formed with a lith film in processes including development and fixation (wet processing) as in conventional photographic film, processes in the developing processing are complicated. Besides, since each processing is conducted by soaking lith films successively in a processing vessel containing a treating liquid (such as developer and fixer) , the management thereof is troublesome as well as having the problem of accelerating the deterioration rate of the developing processing apparatus itself through unclean developing processing devices, and the like.

On the other hand, there exists a developing processing apparatus for the developing processing in a photosensitive material where an image is formed, such as a lith film without conducting complicated processes such as development and fixation (wet processing). In the developing processing apparatus, two kinds of materials, a heat developing photosensitive material and a treating material containing a chemical for forming an image on the heat developing photosensitive material are used. The developing processing of the heat developing photosensitive material is conducted by placing the heat developing photosensitive material where an image is exposed face to face with the treating material, applying heat thereto for a predetermined time and then separating the heat developing photosensitive material from the treating material, and drying (the so-called dry processing).

In such a developing processing apparatus, since a liquid containing a chemical, such as a treating liquid is not used, the user need not be concerned with storage of the liquid, supplement management, or cleaning of the apparatus. In addition, apparatus maintenance can be improved.

However, in conducting heat development using a heat developing photosensitive material, a salt contained in the heat developing photosensitive material itself or a salt generated in the developing process may have adverse effects. The salt herein denotes an inorganic or organic water-washable compound. It includes water-soluble compounds used in a material, and salts generated in the developing process.

That is, it is characteristic of a salt to get sticky by absorbing moisture depending upon the environment humidity due to its high hygroscopic property so that if it is left after the heat development, a phenomenon of high hygroscopic adhesion may occur. Although the high hygroscopic adhesion property can be eliminated by washing, it involves a problem in that the surface to be developed cannot be contacted with a transporting system, and the like until the drying process is completed after washing.

SUMMARY OF THE INVENTION

In consideration of the above-mentioned facts, an object of the present invention is to provide a cleaning device capable of cleaning only a surface where cleaning is necessary with a simple structure.

In addition to the above-mentioned object, another object of the present invention is to provide a cleaning device for a heat developing processing apparatus capable of eliminating the high hygroscopic adhesion property of a heat developing photosensitive material after the heat developing processing regardless of the degree of humidity.

In addition to the above-mentioned objects, yet another object of the present invention is to provide a drying device and a drying device for a heat developing processing capable of drying a wet sheet material without contact with the transporting system in a predetermined direction with a simple structure.

The first aspect is a cleaning device for cleaning one side of a sheet material, comprising a transporting means for transporting the sheet material substantially horizontally, a saucer for storing a cleaning liquid, a cleaning roller stored in the saucer, with the part lower than the rotation axis partially soaked in the cleaning liquid, guiding members arranged respectively at the upstream side and the downstream side with respect to the cleaning roller for guiding the sheet material transported by the transporting means such that it contacts with the cleaning roller at the uppermost point thereof, and a driving means for rotating the cleaning roller at an extremely high linear velocity with respect to the transporting rate of the sheet material by the transporting means for taking out the cleaning liquid by the roller surface such that a flow for cleaning is generated at the contacting portion at the uppermost point.

According to the first aspect, by transporting the sheet material by the transporting means substantially horizontally, it comes in contact with the cleaning roller at the uppermost point thereof by being guided by the guiding means arranged at the upstream side with respect to the cleaning roller. Since the cleaning liquid is taken out from the saucer and a flow is generated at the contacting position by the high speed rotation of the cleaning roller (rotation at an extremely high linear velocity with respect to the transporting rate of the sheet material), the lower side of the sheet material can be cleaned by the flow.

After passing the cleaning roller, the sheet material is guided by the guiding means arranged at the downstream side with respect to the cleaning roller.

Since the transporting direction of the sheet material is limited substantially horizontally by the guiding means, transfer toward the downstream side of the cleaning liquid taken out to the upstream side of the contacting point can be prevented so that a squeeze effect can be provided.

Further, since only one side (lower side) of the sheet material can be cleaned, the drying efficiency in the subsequent drying process can be improved. For example, the drying temperature can be lowered, the drying transporting path length can be shortened, and the drying time can be reduced.

In the second aspect, the lowermost point of the guiding members are arranged slightly lower than the uppermost point of the cleaning roller so that the sheet material is transported while being pressed by two guiding members and one cleaning roller from the upper side and the lower side alternately such that the cleaning liquid's swirling flow at the upstream side of the cleaning roller is brooked.

According to the second aspect, since the lowest point of the guiding members and the highest point of the cleaning roller are arranged alternately, the pressing force of the sheet material onto the cleaning roller increases so that the squeeze effect can be increased without any transfer of the cleaning liquid forming a flow on the upstream side with respect to the point making contact with the cleaning roller to the downstream side beyond the contact point.

The third aspect comprises the first aspect or the second aspect, in which the saucer comprises a member having high heat conductivity so that the cleaning liquid can be heated or the temperature thereof can be maintained heating the saucer itself.

According to the third aspect, by forming the saucer with, for example, a metal such as aluminum, high heat conductivity can be achieved. Therefore, by heating the saucer, the cleaning liquid stored therein can be heated or the temperature thereof can be maintained without providing a heater in the cleaning liquid. The capacity of the cleaning liquid storing vessel can be minimized (rotation area of the cleaning roller).

The fourth aspect comprises the third aspect, in which a supply path is provided in the saucer for storing the cleaning liquid. The cleaning liquid is heated by heat exchange when passing through the supply path.

According to the fourth aspect, since the cleaning liquid injected from the outside can be heated when passing through the supply path formed in the saucer for the cleaning liquid passage so as to be provided to the storing vessel in the saucer, a preliminary means for heating the cleaning liquid is not required.

A fifth aspect is a cleaning device to be used in a developing processing apparatus for heat development of a silver halide photosensitive material where an image is exposed and a processing sheet containing a chemical for forming an image on the silver halide photosensitive material in the presence of a solvent for image formation, in which a cleaning portion is provided for cleaning the developed surface of the silver halide photosensitive material with a cleaning liquid after the heat development.

According to the fifth aspect, an image is formed on the silver halide photosensitive material by the heat development of the silver halide photosensitive material and the processing sheet under the presence of the solvent for image formation. Since the developed surface of the silver halide photosensitive material immediately after the heat development has a hygroscopic property, there is a risk of absorbing moisture from the atmosphere if the apparatus is installed somewhere humid.

This is due to the effect of silver used in the silver halide photosensitive material or silver generated in the heat development process. If left, stickiness occurs which causes dust adhesion, wrinkle generation, or discoloration. Therefore, only the developed surface of the silver halide photosensitive material is cleaned by the cleaning portion after the heat developing processing. Accordingly, the hygroscopic property itself can be eliminated and stickiness avoided.

Since only the developed surface of the silver halide photosensitive material can be cleaned, the drying efficiency in the subsequent drying process can be improved.

A sixth aspect is to be used in a developing processing apparatus for heat development of a silver halide photosensitive material where an image is exposed and a processing sheet containing a chemical for forming an image on the silver halide photosensitive material in the presence of a solvent for image formation, comprising a cleaning portion for cleaning at least the developed surface of the silver halide photosensitive material with a cleaning liquid after the heat development, and a squeeze portion for wiping off the cleaning liquid attached to the silver halide photosensitive material after cleaning by the cleaning portion.

According to the sixth aspect, by the heat development of the silver halide photosensitive material and the processing sheet in the presence of the solvent for image formation, an image is formed on the silver halide photosensitive material. Since the developed surface of the silver halide photosensitive material immediately after the heat development has a hygroscopic property, there is a risk of absorbing moisture from the atmosphere when the apparatus is installed somewhere humid.

This is due to the effect of silver used in the silver halide photosensitive material or silver generated in the heat development process. If left, stickiness is generated. This causes dust adhesion, wrinkle generation, or discoloration. Therefore, only the developed surface of the silver halide photosensitive material is cleaned by the cleaning portion after the heat developing processing. Accordingly, the hygroscopic property itself can be eliminated and stickiness avoided.

The squeeze portion is provided on the downstream side of the cleaning portion for wiping off the cleaning liquid attached to the silver halide photosensitive material after being cleaned by the cleaning portion. In this way, the drying efficiency in the subsequent drying process can be improved.

A seventh aspect comprises a cleaning tank for storing the cleaning liquid for the cleaning portion, and a guiding means for guiding the silver halide photosensitive material into the cleaning tank so as to be soaked in the cleaning liquid for a predetermined time according to the transportation.

According to the seventh aspect, the cleaning tank for storing the cleaning liquid is provided as the cleaning portion so that the silver halide photosensitive material can be immersed in the cleaning liquid in the cleaning tank. This configuration is the simplest one, which can be provided in the transporting path with a good maintenance property.

An eighth aspect comprises a cleaning liquid jetting pipe having a plurality of small holes toward the surface to be developed, and a pressure supply means for supplying the cleaning liquid to the cleaning liquid jetting pipe with pressure, in which the cleaning portion is provided on the surface of the side to be developed in the transporting path of the silver halide photosensitive material.

According to the eighth aspect, the cleaning liquid is jetted only to the surface to be developed of the silver halide photosensitive material in the cleaning portion. According to this configuration, since the cleaning liquid of the necessary amount can be jetted without storing the cleaning liquid, consumption of the cleaning liquid can be reduced. Furthermore, since the liquid is jetted with force (pressure jetting), cleaning can be improved. The consumption of the cleaning liquid can be further reduced by collecting the jetted cleaning liquid for reuse (it is preferable to collect it through a filter).

A ninth aspect is a drying device for drying a sheet material having one surface wetter than the other, comprising a hot air discharging means for blowing hot air onto the sheet material provided on the wetter surface side of the sheet material, and a transporting means for transporting the sheet material in a predetermined direction.

According to the ninth aspect, hot air is blown to the wetter surface side of the sheet material from the hot air discharging means. By the blowing pressure at this time, the sheet material is pressed so that the other surface side is in contact with and supported by a part of the transporting means. It is also possible to provide a suction means on the less wet surface side for vacuuming the sheet material, or to combine hot air blowing and vacuuming. While maintaining the supporting state, the sheet material is transported in a predetermined direction by the transporting means.

Accordingly, the wetter surface can be applied with the drying processing without coming into contact with the transporting system.

In a tenth aspect, the transporting means comprises a plurality of rollers provided along the transporting path of the sheet material, and a motor for rotating the rollers.

According to the tenth aspect, the sheet material can be transported while being supported by the plurality of rollers, which are driven by the driving force of the motor.

An eleventh aspect is to be used in a developing processing apparatus for heat development of a silver halide photosensitive material where an image is exposed and a processing sheet containing a chemical for forming an image on the silver halide photosensitive material in the presence of a solvent for image formation, comprising a drying portion for drying the wet surface to be developed of the silver halide photosensitive material after cleaning without coming into contact with the transporting system.

According to the eleventh aspect, by the heat development of the silver halide photosensitive material and the processing sheet in the presence of the solvent for image formation, an image is formed on the silver halide photosensitive material. Since the developed surface of the silver halide photosensitive material immediately after the heat development has a hygroscopic property, there is a risk of absorbing moisture from atmosphere when the apparatus is installed somewhere humid.

This is due to the effect of silver used in the silver halide photosensitive material or silver generated in the heat development process. If left, stickiness is generated. This causes dust adhesion, wrinkle generation, or discoloration. Therefore, the developed surface of the silver halide photosensitive material is cleaned by the cleaning portion after the heat developing processing. Accordingly, the hygroscopic property itself can be eliminated and the stickiness avoided.

The silver halide must be dried. However, since there is a risk of uneven drying if the developed surface is in contact with the transporting system, the drying processing is conducted at the drying portion without contact occurring with the transporting system.

In this case, the surface to be cleaned, that is, the developed surface is predominately cleaned in cleaning the silver halide photosensitive material. The wetness of both surfaces of the silver halide photosensitive material varies. The wetter developed surface can be predominately dried. This improves the drying efficiency.

A twelfth aspect is a drying device for drying a sheet material having one surface wetter than the other. It comprises a hot air discharging means for blowing hot air onto the sheet material provided on the wetter surface side of the sheet material, a belt provided along the transporting direction of the sheet material on the other less wet surface side of the sheet material, and a transporting means for transporting the sheet material in a predetermined direction by moving the belt in the sheet material transporting direction.

According to the twelfth aspect, hot air is blown onto the wetter surface of the sheet material from the hot air discharging means. With this blowing pressure, the sheet material is pressed so that the other surface side is contacted and supported by the belt. It is also preferable to provide suction holes in the belt for sucking the sheet material through the suction holes, or to combine hot air blowing with suction.

While maintaining the supporting state, the sheet material is transported in a predetermined direction by the transporting means.

Accordingly, the wetter surface can be applied with the drying processing without coming into contact with the transporting system.

A thirteenth aspect is a drying device to be used in a developing processing apparatus for heat development of a silver halide photosensitive material where an image is exposed and a processing sheet containing a chemical for forming an image on the silver halide photosensitive material under the presence of a solvent for image formation, comprising a cleaning means for cleaning at least the heat developed surface of the silver halide photosensitive material after the heat development, and a drying means for drying mainly the heat developed surface of the silver halide photosensitive material moistened by the cleaning means, in which the drying means comprises a hot air discharging means provided at the wetter heat developed surface side of the silver halide photosensitive material moistened by cleaning by the cleaning means for blowing hot air to the silver halide photosensitive material, a belt provided along the transporting direction of the silver halide photosensitive material at the other non-heat developed less wet surface side of the silver halide photosensitive material, and a transporting means for transporting the silver halide photosensitive material in a predetermined direction by moving the belt in the silver halide photosensitive material transporting direction while supporting the non-heat developed surface of the silver halide photosensitive material.

According to the thirteenth aspect, the sheet material is a silver halide photosensitive material to be applied with the heat developing processing. The developing processing apparatus for heat developing the silver halide photosensitive material is provided with a cleaning means and a drying device of the first front view.

That is, by the heat development of the silver halide photosensitive material and the processing sheet under the presence of the solvent for image formation, an image is formed on the silver halide photosensitive material. Since the developed surface of the silver halide photosensitive material immediately after the heat development has a hygroscopic property, there is a risk of it absorbing moisture from the atmosphere when the apparatus is installed somewhere humid.

This is due to the effect of silver used in the silver halide photosensitive material or silver generated in the heat development process. If left, stickiness is generated and dust adhesion, wrinkle generation, or discoloration occur. Therefore, only the developed surface of the silver halide photosensitive material is cleaned by the cleaning portion after the heat developing processing and then dried. Accordingly, the hygroscopic property itself can be eliminated and stickiness avoided.

BRIEF DESCRIPTION OF THE DRAWINGS

FIG. 2(A) is a schematic side view of the heat developing portion, and

FIG. 2(B) is a front view showing the unfolded state of a plurality of hot plates provided in the heat developing portion.

DESCRIPTION OF THE PREFERRED EMBODIMENTS

Figure 1:
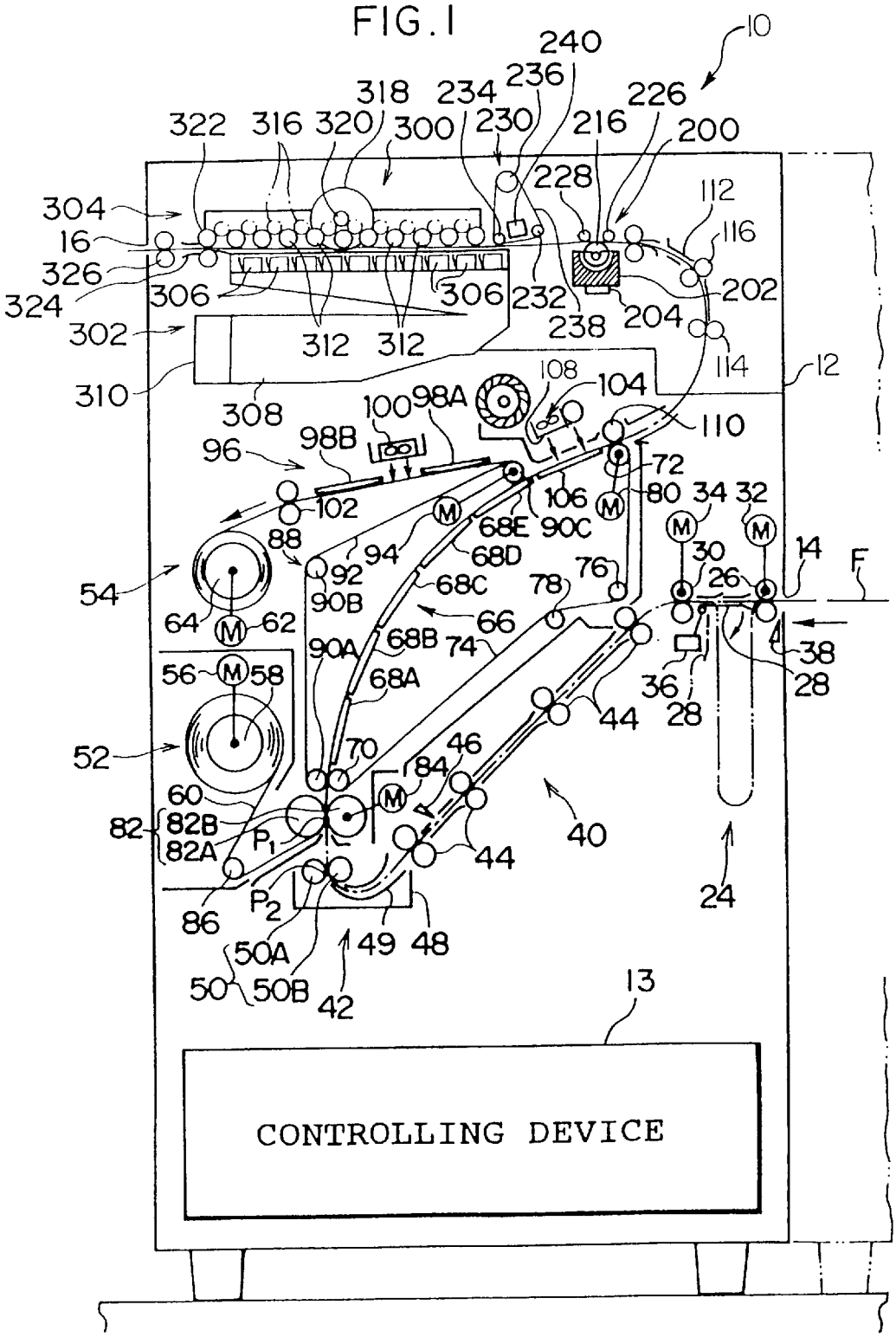
FIG. 1 is a diagram showing the entire configuration of a developing processing apparatus to be used with an embodiment of the present invention.

FIG. 1 shows the internal configuration of a developing processing apparatus 10 of an embodiment of the present invention. The developing processing apparatus 10 is for the developing processing of, for example, a lith film (of, for example, B5 to A0 size) for forming a binary image to be used in newspaper or magazine printing. In this embodiment, the lith film to be applied with the developing processing is referred to as the film F hereinafter.

The film F applied to this embodiment corresponds with the silver halide photosensitive material of the present invention, containing a photosensitive silver halide emulsion of at least 70 mole % or more silver chloride, a hydrophilic binder, and a basic metal compound slightly water soluble on a substrate.

As shown in FIG. 1, the main body 12 of the developing processing apparatus 10 has a box-like shape. An exposing device is provided on the right side of the developing processing device 10 for exposing an image on the film F to be discharged.

A slit-like inserting opening 14 is provided on the right side surface of the developing processing apparatus 10 for inserting undeveloped film F. The film F inserted from the inserting opening 14 gets heat developed by a heat developing portion 66 described later. A water washing portion 200 for washing a developed film F with water (cleaning) as the cleaning portion and a drying portion 300 are provided in the upper part of the developing processing apparatus 10. The film F is transported substantially horizontally so as to be discharged from the discharging opening 16 on the left side of the apparatus.

A door (not illustrated) is provided on the left side surface of the main body 12 of the developing processing apparatus 10. By opening or closing the door, the inside can be exposed.

Hereinafter the apparatus configuration will be explained in detail according to the transporting order of the film F.

An inserting buffer portion 24 is provided on the right side in the main body 12 of the developing processing apparatus 10 for temporarily holding the film F inserted from the inserting opening 14.

The inserting buffer portion 24 comprises a transporting roller 26, a branching guide 28 and a transporting roller 30, arranged in order. The transporting roller 26 is driven by a motor 32. The transporting roller 30 is driven by a motor 34.

The branching guide 28 can be switched by a solenoid 36 either to the horizontal state shown by the solid line in FIG. 1 or to the vertical state shown by the imaginary line. When it is switched to the vertical state, as shown by the imaginary line in FIG. 1, the film F can be loosened between the transporting roller 26 and the transporting roller 30.

The difference between the treating speed of the developing processing apparatus 10 (for example, 30 mm/sec) and the treating speed of the exposing device 11 (for example, 100 mm/sec) can be absorbed by the inserting buffer portion 24.

An insertion sensor 38 is provided between the inserting opening 14 and the transporting roller 26 for detecting the film F.

A photosensitive material inputting portion 40 and a water applying portion 42 as the application means for water as the solvent for image formation are provided on the downstream side with respect to the transporting roller 30 in the transporting direction of the film F. Other examples of applicable solvents for image formation include a solvent mixture of water and a low boiling point solvent such as methanol, DMF, acetone, diisobutyl ketone and the like. Further, a solution containing an image formation enhancing agent, a fogging preventive, a developing stopping agent, a hydrophilic heat solvent, an antiseptic, an anti mildew agent or the like can also be used.

A plurality of transporting rollers 44 are provided in the photosensitive material inputting portion 40 for transporting the film F from the inserting buffer portion 24 to the water applying portion 42. A waiting sensor 46 is provided in the middle part of the film transporting path in the photosensitive material inputting portion 40 for detecting the film F.

An application tank 48, and a replenishing tank and a pump (not illustrated) for replenishing the application tank 48 with water are provided in the water applying portion 42.

The application tank 48 is formed to have a plate-like shape to be filled with water as the solvent for image formation. Furthermore, an arc-like guide 49 is provided in the application tank 48 for soaking the film F into the water. By applying water on the film F, the adhesion between the film F and a processing sheet 60 can be improved in the heat developing portion 66 later described.

A squeeze roller 50, comprising horizontally arranged roller 50A and roller 50B, is provided above the application tank 48 for transporting the film F upward while eliminating excessive water thereon. The rotation center of the roller 50A and the rotation center of the roller 50B exist in the same horizontal plane so that the squeeze roller 50 can transport the film F straight up by holding it therebetween.

A processing sheet unwinding portion 52 is provided as the storing portion on the left side in the main body 12 of the developing processing apparatus 10. A processing sheet winding portion 54 is provided as the collecting portion above the processing sheet unwinding portion 52.

A supply shaft 58 driven by a motor 56 is detachably attached to the processing sheet unwinding portion 52. A long processing sheet 60 is wound like a roll around the supply shaft 58.

On the other hand, a winding shaft 64 driven by a motor 62 is detachably attached to the processing sheet winding portion 54 so that the processing sheet 60 fed from the supply shaft 58 can be wound by the winding shaft 64. The supply shaft 58 and the winding shaft 64 can be removed by opening the door (not illustrated) provided on the left side surface of the main body 12.

Figure 2B:
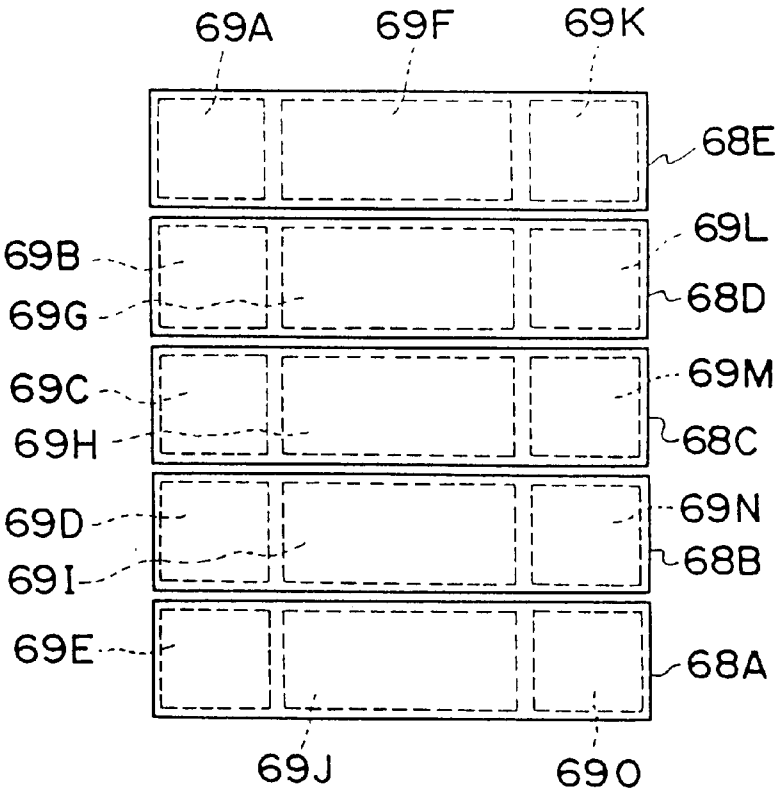
FIGS. 2(A), 2(B) are schematic diagrams showing a heat developing portion in the developing processing apparatus to be used with the embodiment of the present invention.
Figure 2A:
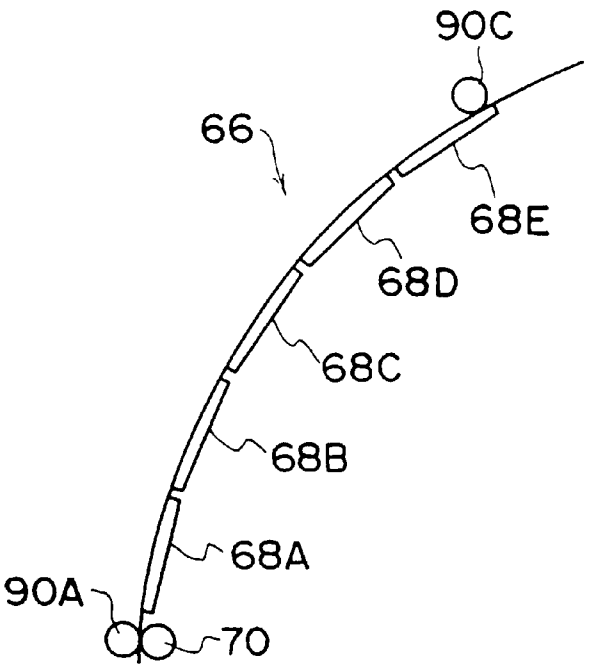

A heat developing portion 66, acting as the heating means, is provided in substantially the center part of the main body 12 of the developing processing apparatus 10. As shown in FIGS. 1 and 2(A), the heat developing portion 66 is provided with a plurality of hot plates 68A to 68E arranged in an arc-like manner (in this embodiment, 5 pieces) . The hot plates 68A to 68E have a substantially rectangular shape as shown in FIG. 2(B), plane heaters 69A to 69O and temperature sensors (not illustrated). There of each heater, 69A to 69O, are provided on the hot plates 68A to 68E. The heaters 69F to 69J provided in the center part of the hot plates 68A to 68E have a length double that of the heaters 69A to 69E, 69K to 69O provided at both ends of the hot plates 68A to 68E.

Since the temperature of the plurality of the heaters 69A to 69O stored in the hot plates 68A to 68E can be set independently to have different temperatures by a controlling device 13, the temperature difference can be generated in each area in the hot plates 68A to 68E.

In this embodiment, the temperature of the heaters 69F to 69J provided in the center part of the hot plates 68A to 68E is set to be 80° C., which is a temperature appropriate for the heat developing processing of the film F and the processing sheet 60 to with it is attached. On the other hand, the temperature of the heaters 69A to 69E, 69K to 69O provided at both ends of the hot plates 68A to 68E is set to be 90° C., which is higher than the temperature of the heaters 69F to 69J provided in the center part of the hot plates 68A to 68E, that is, the temperature appropriate for the heat developing processing by a predetermined temperature. Accordingly, the temperature of the heaters 69A to 69O is set such that a temperature difference of about 10° C. is generated between the center part and the end parts in the hot plates 68A to 68E.

In the heat developing portion 66, through the temperature rise of the film F when heated by the hot plates 68A to 68E, it reaches the temperature appropriate for developing processing as well as by the function of a complex forming compound, a physical phenomenon nucleus and a silver halide solvent contained in the processing sheet 60 act on the film F, and an image can be formed on the film F.

As shown in FIG. 1, a roller 70 is provided below the lowermost hot plate 68A in the heat developing portion 66 on the right side of the transporting path of the film F indicated by the broken line. A hot plate 106 is further provided beside the hot plate 68E of the heat developing portion 66 along the transporting path of the film F. A roller 72 is provided below the transporting path of the film F on the right side of the hot plate 106. The hot plate 106 is used for heat drying the film F.

A belt 74 to be contacted with the rear side of the film F is wound around the roller 70, the hot plates 68A to 68E, the hot plate 106 and the roller 72. The belt 74 is wound around also to the rollers 76, 78. The rollers 70, 72, 76, 78 are interlocked to each other by a timing belt (not illustrated) or a chain so as to be driven by a motor 80.

An adhesion roller 82, comprising a roller 82A and a roller 82B, is provided below the roller 70 as the laminating means. The roller 82B can be driven by a motor 84. The roller 82A is forced toward the roller 82B by a spring (not illustrated).

Herein the rotation center of the roller 82A and the rotation center of the roller 82B of the adhesion roller 82 exist in the same horizontal plane and the contacting point $P_1$ of the roller 82A and the roller 82B is positioned just above the contacting point $P_2$ of the roller 50A and the roller 50B of the squeeze roller 50. Accordingly, the film F applied with water can be transported straight up by the squeeze roller 50.

Moreover, since the rotation center of the roller 82A and the rotation center of the roller 82B of the adhesion roller 82 exist in the same horizontal plane, even when the rear end of the film F in the transporting direction is separated from the squeeze roller 50 when being transported, the latter half portion of the film F in the transporting direction can be transported by the adhesion roller 82 while maintaining the vertical state through its own weight. Therefore, the film F applied with water can be kept adhered to the processing sheet 60 from the top end to the rear end while maintaining a predetermined angle.

Furthermore, a roller 86 for winding the processing sheet 60 is provided below the above-mentioned supply shaft 58 so that the processing sheet 60 fed out from the supply shaft 58 is wound around the roller 86, then transported along the hot plates 68A to 68E via the adhesion roller 82.

Since the hot plates 68A to 68E are heated by the heaters 69A to 69O to have the temperature appropriate for heat developing processing in the center part with both end parts having a temperature higher than the center part by a predetermined temperature as mentioned above, the extension of the processing sheet 60 in both end parts is larger than that in the center part when the adhered film F and processing sheet 60 are transported along the surface of the hot plates 68A to 68E. Therefore, slackening in the vicinity of the center part of the processing sheet 60 can be alleviated to prevent wrinkle generation.

Accordingly, since the film F and the processing sheet 60 can be transported in a securely adhered state along the surface of the hot plates 68A to 68E, a preferable image can be formed on the film F.

A forcing device 88 is provided opposite the hot plates 68A to 68E. The forcing device 88 comprises rollers 90A, 90B, 90C and a belt 92 wound around the rollers 90A, 90B, 90C so as to apply force to the processing sheet 60 toward the outer periphery of the hot plates 68A to 68E. The rollers 90A, 90B, 90C are interlocked by a timing belt (not illustrated) or a chain so as to be driven by a motor 94.

A processing sheet drying portion 96 is provided above the forcing device 88. The processing sheet drying portion 96 comprises hot plates 98A, 98B for heating the processing sheet 60, a fan 100 for blowing air to the processing sheet 60, and a holding roller 102 for having the processing sheet 60 in contact with or proximate to the hot plates 98A, 98B.

A film drying portion 104 is provided on the downstream side in the transporting direction of the film F with respect to the heat developing portion 66. The film drying portion 104 comprises a hot plate 106 for heating the film F and a fan 108 for blowing air onto the film F.

A roller 110 is provided on the downstream side in the transporting direction of the film F with respect to the film drying portion 104 for feeding out the film F by holding it with the belt 74 wound around the roller 72.

The film F transported by the belt 74 wound around the roller 72 and the roller 110 is sent to the subsequent water washing portion 200 by a transporting roller 114 and a transporting roller 116 via a substantially U-shaped transporting guide 112.

Figure 3:
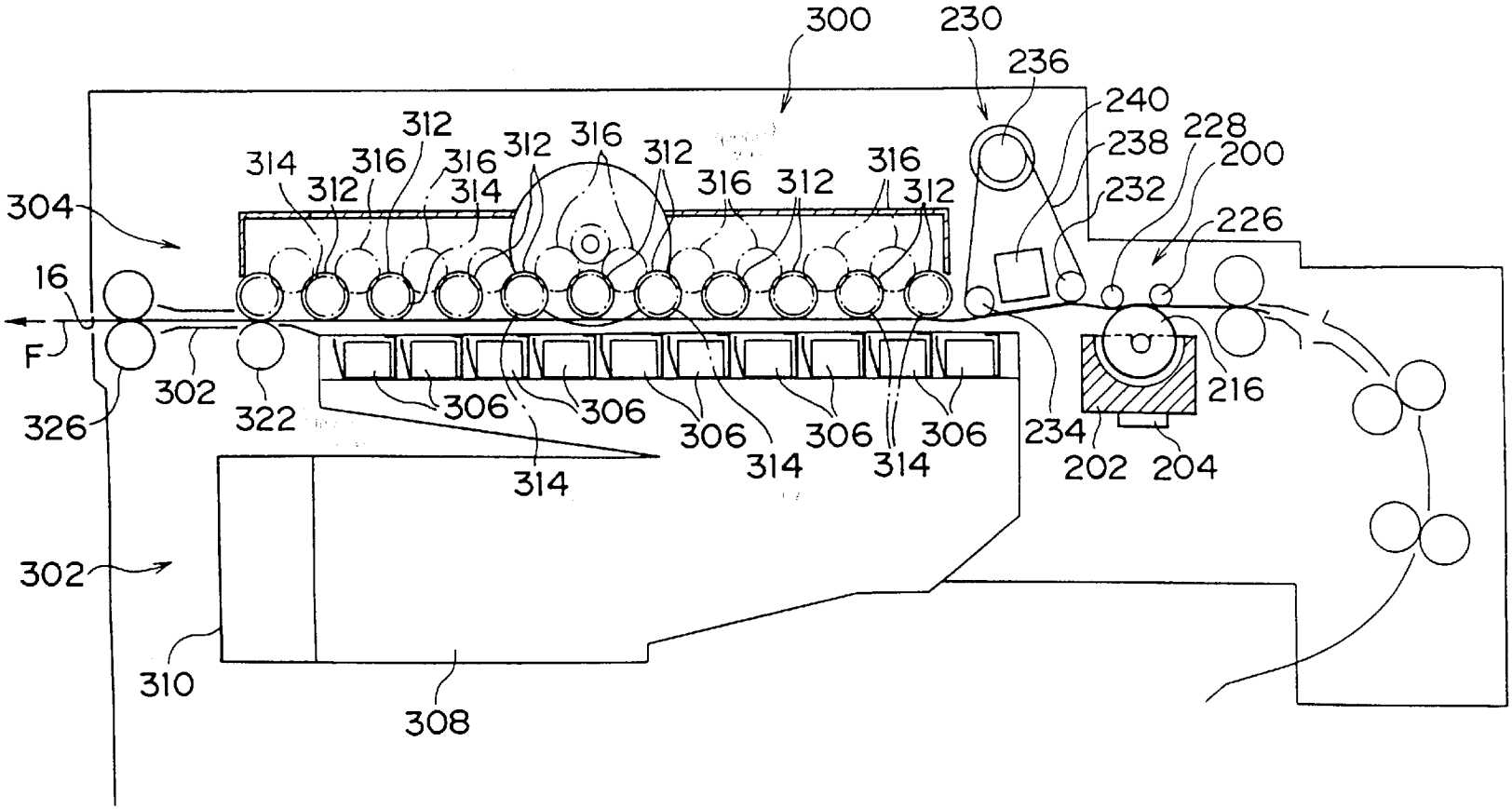
FIG. 3 is an enlarged diagram of a water washing portion and a drying portion for a film applied with the heat developing processing of the embodiment.
Figure 4:
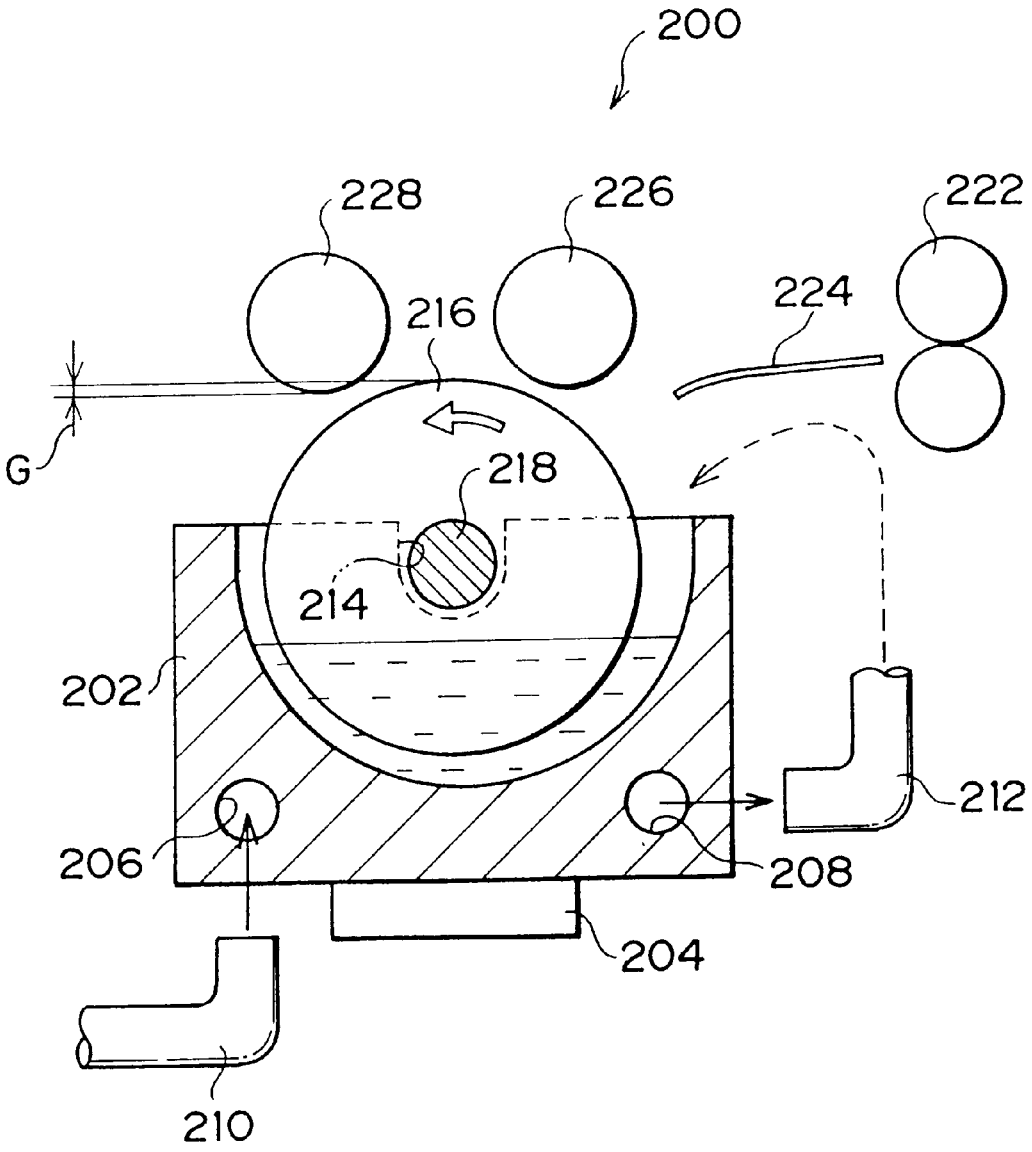
FIG. 4 is a detailed diagram of the water washing portion for a film applied with the heat developing processing of the embodiment.
Figure 5:
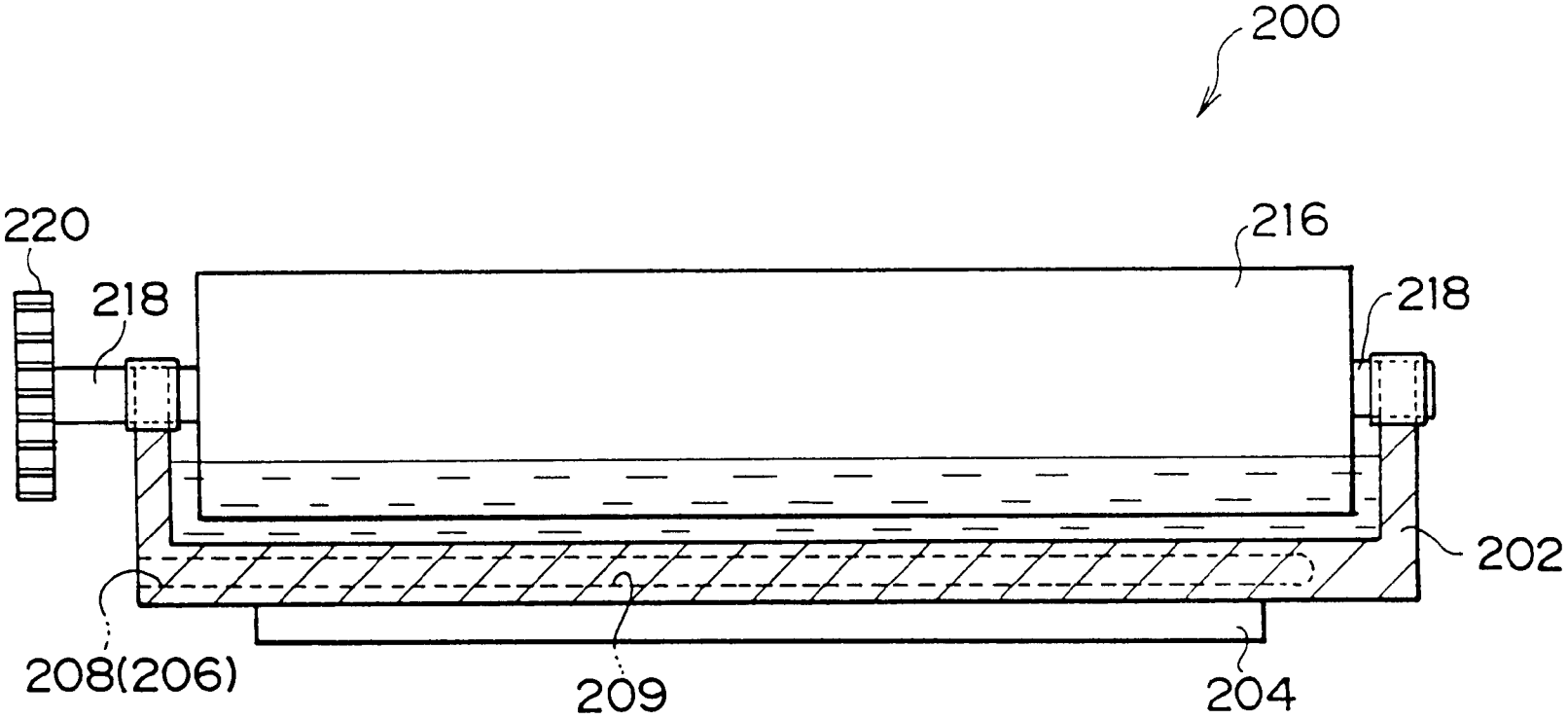
FIG. 5 is a cross-sectional diagram as viewed from the right side of FIG. 4.

As shown in FIGS. 3 to 5, the water washing portion 200 is provided with a water washing vessel 202 as the saucer for storing washing water. Since water is used as the cleaning liquid in this embodiment, hereinafter cleaning is referred to as water washing and a cleaning liquid as washing water.

The water washing vessel 202 is made of aluminum with a rectangular shape externally with the longitudinal direction provided along the width direction of the film F, and with a substantially U-shaped groove-like cross-section internally to serve as the storing portion for washing water. The water washing vessel 202 is applied with an acrylic electrodeposition coating on the surface to prevent corrosion by the alkaline solution.

A heater unit 204 is provided on the bottom face of the water washing vessel 202. The water washing vessel 202 itself is heated by the heater unit 204. Since the water washing vessel 202 is made of aluminum to have a high heat conductivity, the water washing vessel 202 can be heated without unevenness.

Round holes 206, 208 are provided on corners at one side in the lower part of the water washing vessel 202. The round holes 206, 208 are elongated along the longitudinal direction of the water washing vessel 202 respectively and bent so as to communicate with each other just before the other side to form a substantially U-shaped guiding path 209 as the supply path as a whole.

A pipe 210 is connected to one of the round holes 206 from a washing water tank (not illustrated) provided outside the apparatus so as to supply washing water driven by a pump. A pipe 212 is connected to the other round hole 208 with the opening of the pipe 212 provided toward the above-mentioned washing water storing portion.

Therefore, washing water supplied from the washing water tank reaches the storing portion after passing through the substantially U-shaped guiding path 209 provided in the water washing vessel 202 while the washing water is heated so as to be stored after attaining an appropriate temperature (40° C. to 45° C.). The temperature of the stored washing water is maintained so as to keep the appropriate temperature. The above-mentioned temperature range is set because water washing effect of the film F cannot be expected with a temperature lower than 40° C. Water washing effect does not change and the washing water tends to evaporate easily and increases the washing water consumption with a temperature higher than 50° C.

Substantially U-shaped grooves 214 with the upper end opened are formed on both ends in the longitudinal direction of the water washing vessel 202 so as to hook the rotation shaft 218 of the water washing roller 216. Accordingly, about the bottom third of the water washing roller 216 is soaked in the washing water.

A gear 220 (see FIG. 5) is attached to one of the rotation shafts 218 and interlocked with the driving shaft of a motor (not illustrated) . By the driving force of the motor, the water washing roller 216 rotates in the same direction as the transporting direction of the film F. The water washing roller 216 has a 43 mm outer diameter and rotates at 400 rpm. As a result, the linear velocity becomes 900 mm/sec. On the other hand, the transporting speed of the film F transported by the driving force of a pair of transporting rollers 222 arranged on the upstream side with respect to the water washing portion 200 is 27.5 mm/sec. The speed ratio is about 30:1. A guiding plate 224 is provided between the transporting rollers 222 and the water washing portion 200 so that the film F can be transported to the uppermost point position of the water washing roller 216 securely.

Figure 6:
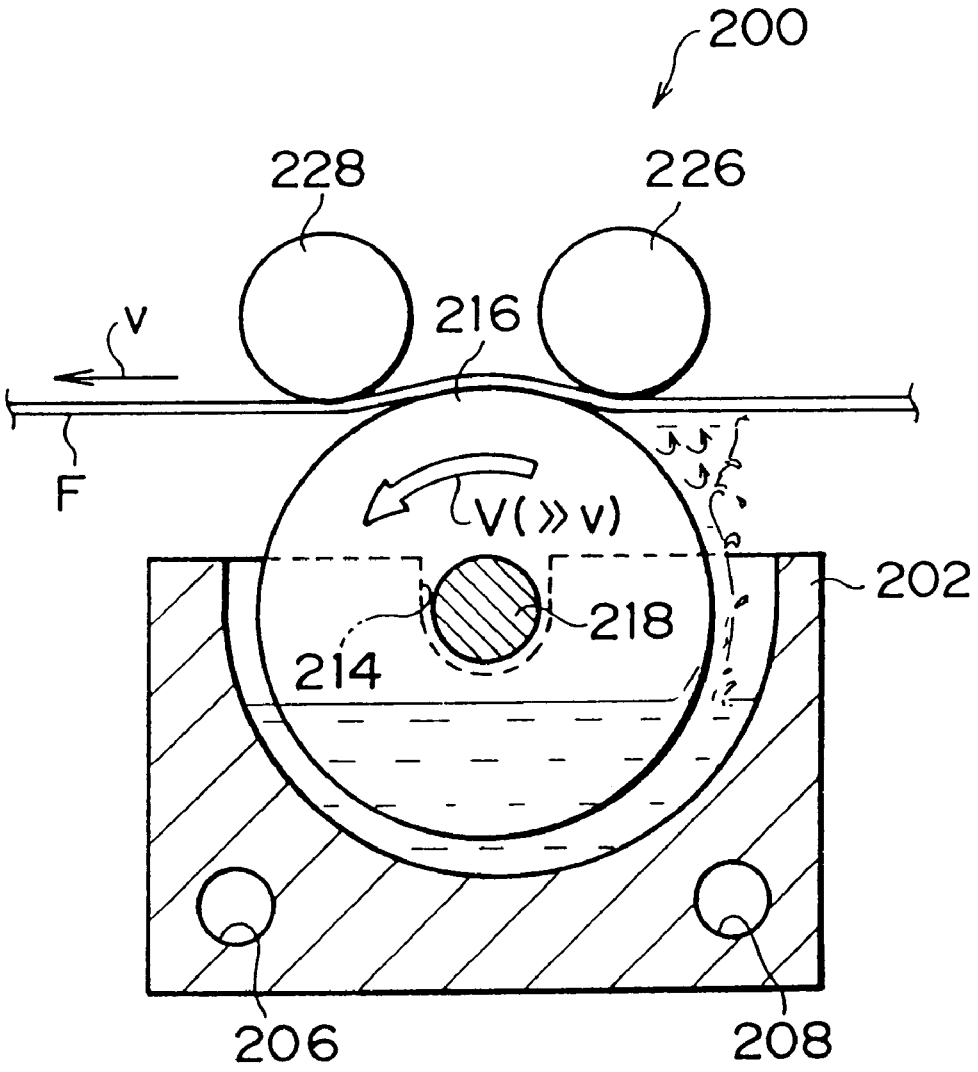
FIG. 6 is an operational diagram showing the situation during cleaning with washing water and squeezing in the water washing portion of FIG. 4.

A pair of guiding rollers 226, 228 are provided above the water washing roller 216. The lowermost point of the guiding rollers 226, 228 are arranged below the uppermost point of the above-mentioned water washing roller 216. The offset amount (size G in FIG. 4) is 0.5 to 1.0 mm. On the other hand, the thickness of the film F is 100 $\mu$m. Therefore, as shown in FIG. 6, the film F can be transported while contacting with the lowermost point of the guiding roller (upstream side) 226, the uppermost point of the water washing roller 216, and the lowermost point of the guiding roller (downstream side) 228 successively so that it is transported while pressed at each point so as to meander microscopically. The water washing roller 216 rotates while rubbing the surface (lower surface) of the film F, however, since the surface of the water washing roller 216 is mirror finished, the contacting surface of the film F cannot be damaged.

To the film F transported accordingly, the water washing roller 216 takes out the washing water by its high speed rotation (400 rpm) and generates a flow just before (upstream side) the portion contacting with the film F at the uppermost point. By this flow, the lower surface of the film F can be washed with water to remove a salt having a high humidity adhesive property.

If the film F is a film for the contact exposure to a PS block as a newspaper original block, for example, the problems such as bubble or wrinkle generation caused by the lack of smoothness at the time of attachment to the PS block can be solved.

The flow herein is generated only at the upstream side with respect to the uppermost point of the water washing roller 216, but cannot be at the downstream side owing to the pressure at the above-mentioned three points. As a result, the squeeze function can be provided. Therefore, the film F passed through the uppermost point of the water washing roller 216 hardly has water thereon so as to be sent to the drying portion 300 via a delivery portion 230 (later described) in a half dry state.

Hot air from the drying portion 300 is partially supplied to the above-mentioned guiding rollers 226, 228 to prevent dew condensation.

Figure 7:
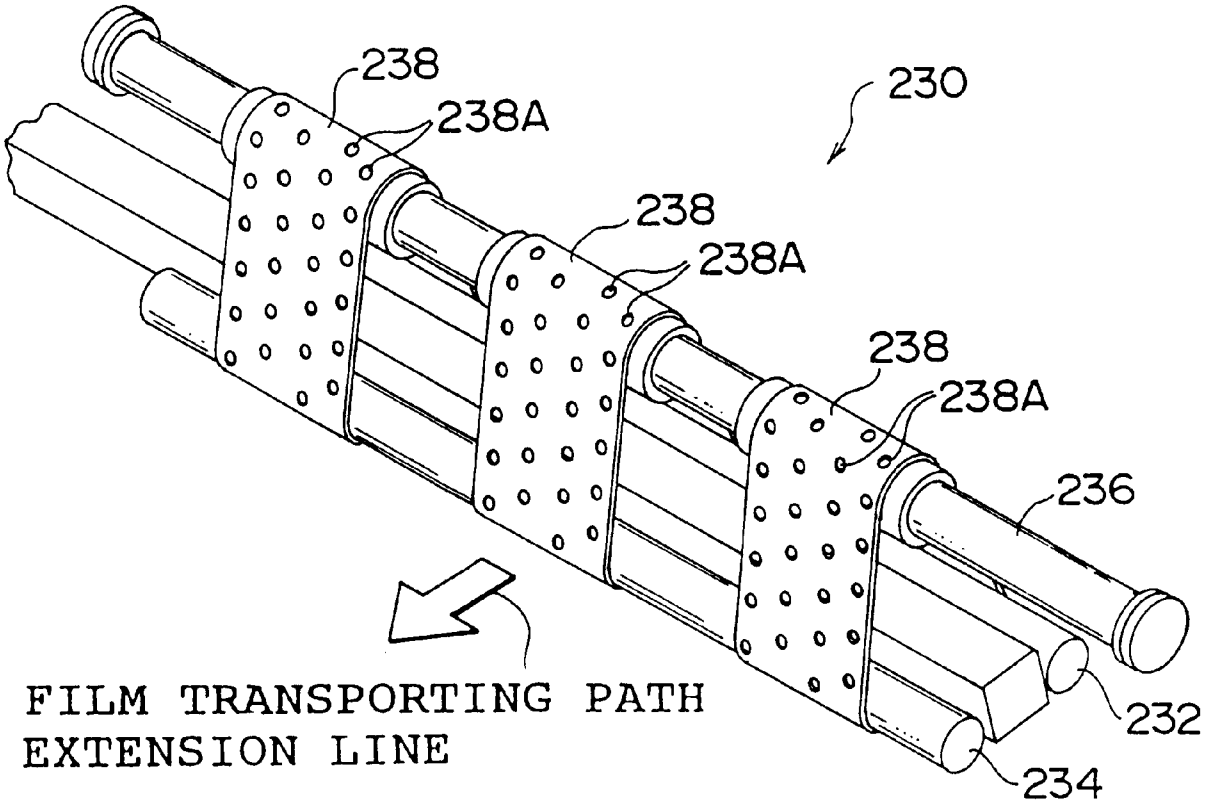
FIG. 7 is an angled view of a delivery portion of the embodiment.

As shown in FIGS. 2 and 7, the delivery portion 230 is provided between the water washing portion 200 and the drying portion 300.

The delivery portion 230 comprises a first roller 232 provided slightly above the transporting path extension line of the film F discharged from the water washing portion 200, and a second roller 234 provided substantially on the transporting path extension line of the film F on the downstream side with respect to the first roller 232. A driving roller 236 is provided at a position of the vertex of a triangle formed with the first roller 232 and the second roller 234 as the ends of the base.

Belts 238 are wound around the three rollers 232, 234, 236. The three belts 238 having a narrow width, are arranged evenly in the axial direction of the rollers 232, 234, 236. A plurality of holes 238A are arranged triangularly in the belts 238.

A suction means 240 is provided inside the belt 238 wound in a triangular shape so as to guide the air in the direction to vacuum the belts 238.

Therefore, the holes provided in the belts 238 serve as the suction holes to attract the film F discharged from the water washing portion 200.

Since the film F is delivered to the drying portion 300 while being vacuumed by the belts 238 if the driving roller 236 is driven in this state, the lower surface (developed surface) applied with the water washing processing in the water washing portion 200 can be maintained in the uncontacted state.

As shown in FIG. 2, the drying portion 300 has a hot air generating portion 302 in the lower part and a film guiding portion 304 in the upper part with respect to the substantially linear transporting path space of the film F.

In the hot air generating portion 302, a plurality of narrow box-like hot air discharging portions 306 with the longitudinal direction arranged in the film transporting width direction are provided in the film transporting direction. A slit hole is provided along the film width direction respectively in the hot air discharging portions 306 so that the hot air can be blown out by applying pressure to the inside of the hot air discharging portions 306.

A communicating opening with a hot air guiding duct 308 provided below the hot air discharging portions 306 is provided for the end portion of each of the hot air discharging portions 306. Hot air supplied from a blower 310 with pressure and heated by the heater (not illustrated) is supplied to the hot air guiding duct 308. The capacity of the hot air guiding duct 308 becomes gradually smaller toward the downstream side of the drying portion 300 so as to keep the pressure for sending to the hot air discharging portions 306 constant. Accordingly, the hot air can be blown out with a substantially constant air amount from the most upstream side to the most downstream side of the drying portion 300.

On the other hand, a plurality of rollers 312 are provided along the film transporting direction in the film guiding portion 304. To the plurality of rollers 312, gears 314 are attached axially such that adjacent gears 314 are engaged to an intermediate gear 316. A gear 320 attached to the rotation shaft of the motor 318 is engaged with two intermediate gears 316 arranged substantially at the center part in the film transporting direction.

Therefore, when the motor 318 starts driving, the driving force is transmitted to the two intermediate gears 316 arranged in the above-mentioned center part from the gear 320. Then the driving force is transmitted to the gears 314 attached to the rollers 312, the intermediate gears 316, as far as the gears 314 attached to the rollers 312 at both end portions. Accordingly, all the plurality of rollers 312 can be driven at the same rotation speed in the same direction.

The film F transported to the drying portion 300 is pushed up to the plurality of the rollers 312 side by the hot air from the hot air discharging portion 306 so as to be transported by the rotation driving force of the rollers 312 at a constant speed. During the transportation, the lower surface (surface washed with water in the water washing portion 200) can be in the uncontacted state. It is also possible to vacuum from the space between the rollers 312 by a suction means (not illustrated) to stabilize the transportation.

A pair of transporting rollers 322, a guiding plate 324, and a pair of discharging rollers 326 are provided at the most downstream side of the drying portion 300. The film F after drying is discharged from the drying portion 300 while being held by the transporting rollers 322 and guided by the guiding plate 324 to be discharged from a discharging opening 16 by the discharging rollers 326.

Effects of the embodiment of the present invention will be explained hereinafter.

In the developing processing apparatus 10, when the exposed film F discharged from the exposing device 11 is inserted to the inserting opening 14, the film F is detected by the insertion sensor 38 so that the transporting roller 26 is driven at a speed corresponding to the insertion speed of the film F to transport the film F to the inside of the developing processing apparatus 10.

Since the processing speed of the film F in the developing processing apparatus 10 (from the transporting roller 30 and after) is slower than the insertion speed of the film F, when the edge of the film F is held by the transporting roller 30, the branching guide 28 is switched to the vertical state indicated by the imaginary line. Accordingly, the rear side of the film F in the transporting direction hangs down as indicated by the imaginary line in FIG. 1.

The film F transported by the transporting roller 30 is transported to the water applying portion 42 by the transporting roller 44 of the photosensitive material inputting portion 40. The film F is soaked into the water stored in the application tank 48, then transported just upward after eliminating extra water by the squeeze roller 50.

When a predetermined time passes after the detection of the edge of the film F by the waiting sensor 46, the belt 74, the belt 92 and the processing sheet 60 are transported at a speed the same as the transporting speed of the film F so that the film F applied with water and the processing sheet 60 are adhered by the adhesion roller 82 and transported to the heat developing portion 66.

In the heat developing portion 66, the film F and the processing sheet 60 adhered by the adhesion roller 82 are forced toward the hot plates 68A to 68E by the forcing device 88 so as to be transported while being in contact with or proximate to the heating surface of the hot plates 68A to 68E. The hot plates 68A to 68E are heated by the heaters 69A to 69O stored therein with the temperature difference in the areas of the hot plates 68A to 68E.

In this embodiment, the center part of the hot plates 68A to 68E is heated to the temperature appropriate for the heat developing processing (80° C.) by the heaters 69F to 69J provided in the center part of the hot plates 68A to 68E and both end parts of the hot plates 68A to 68E is heated to a temperature higher by a predetermined temperature (90° C.).

Since the extension of the processing sheet 60 transported along the surface of the hot plates 68A to 68E in both end parts is larger than that in the center part, liable slackening in the vicinity of the center part of the processing sheet 60 can be alleviated to prevent wrinkle generation. Therefore, since the film F and the processing sheet 60 can be transported in a securely adhered state along the surface of the hot plates 68A to 79E, for heat developing process, a preferable image can be formed on the film F.

When the heat developed film F and the processing sheet 60 are transported to the rear end of the heat developing portion 66, the processing sheet 60 is separated from the film F by the roller 90C, dried by the processing sheet drying portion 96, and wound up by the winding shaft 64.

On the other hand, the film F separated from the processing sheet 60 is applied with the drying processing by the film drying portion 104, and sent to the water washing portion 200 via the transporting guide 112, the transporting roller 114 and the transporting roller 116.

The film F held by the transporting roller 222 at the upstream side in the water washing portion 200 is transported so as to be in contact with the uppermost point of the water washing roller 216 in the substantially horizontal state.

Herein , the film F comes in contact with the lowermost points of the guiding rollers 226, 228 on the upstream side and the downstream side with respect to the water washing roller 216. Since the lowermost points are offset downward by the size G (0.5 to 1.0 mm) with respect to the uppermost point of the water washing roller 216, the film F can be transported while being pressed at the three points so as to meander microscopically.

On the other hand, the water washing roller 216 takes out the washing water stored in the storing portion by its high speed rotation and generates a flow on the upstream side with respect to the uppermost point of the water washing roller 216. By this flow, the lower surface of the film F can be washed with water to remove a salt to generate a high humidity adhesive property.

Since the film F is pressed at the uppermost point of the water washing roller 216, the washing water generating the flow cannot reach the downstream side with respect to the uppermost point, the film F can be separated from the water washing roller 216 in a squeezed state.

Accordingly, by offsetting the uppermost point and the lowermost points of the water washing roller 216 and the guiding rollers 226, 228 alternately, both functions of flow generation for water washing and squeezing can be achieved.

The film F separates from the water washing roller 216 is transported to the delivery portion 230 so as to be vacuumed by the belts 238 arranged above the film F. Therefore, the lower surface of the film F applied with washing processing with washing water is in an uncontacted state. While maintaining the uncontacted state, the film F is transported to the drying portion 300.

In the drying portion 300, the film F can be pushed up by the hot air from the hot air discharging portion 306 toward the plurality of rollers 312 of the film guiding portion 304. The rollers 312 rotate in the same direction at the same speed so that the pushed-up film F is transported by the plurality of rollers 312 at a constant speed to be dried gradually.

Since water drops are barely on the film F for the film F is washed in the water washing portion 200 with water only in the lower surface thereof and applied with squeezing, it can be dried extremely efficiently in the drying portion 300. Therefore, a higher drying speed, a shorter drying path length, a lower drying temperature, a smaller drying air supply amount, and the like, can be achieved.

The film F after drying is transported along the transporting roller 322, the guiding plate 324, and the discharging roller 326 so as to be discharged from the discharging opening 16.

(Modified embodiment of the water washing portion 1)

Figure 8:
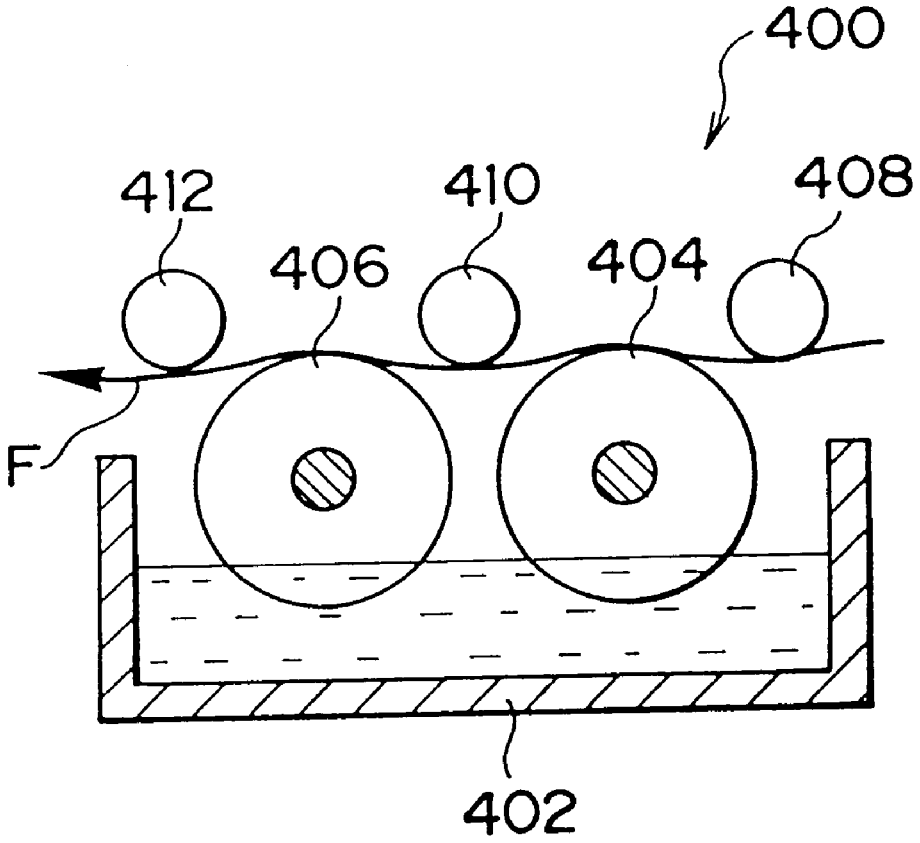
FIG. 8 is a front view of a modified embodiment of the water washing portion.

FIG. 8 shows a first modified embodiment of the water washing portion of the embodiment.

A water washing portion 400 of the first modified embodiment comprises a water washing vessel 402 formed with a long length in the transporting direction, and two water washing rollers 404, 406 provided along the film transporting direction.

Three guiding rollers 408, 410, 412 are provided corresponding to the two water washing rollers 404, 406 alternately so that the two stage water washing can be conducted according to the film F transportation. Owing to the two stage water washing, which allows a preliminary water washing at the first stage and a main water washing at the second stage, the cleaning effect can be improved.

Figure 9:
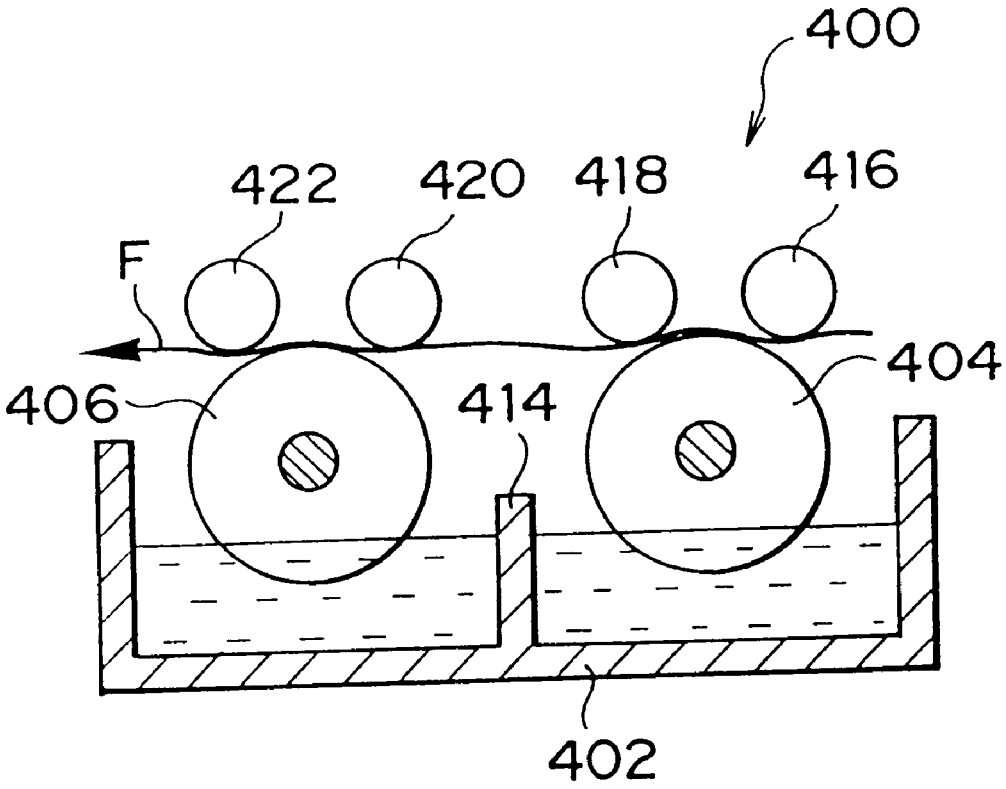
FIG. 9 is a front view of a modified embodiment of the water washing portion.
Figure 10:
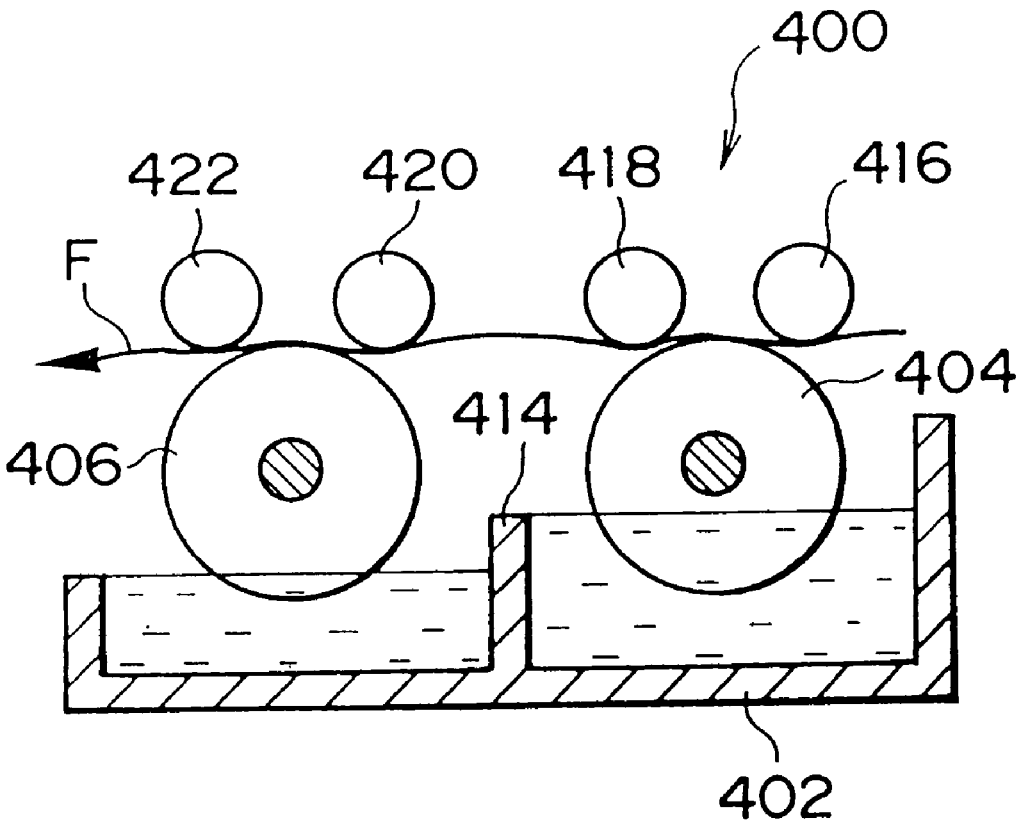
FIG. 10 is a front view of a modified embodiment of the water washing portion.

In this case, as shown in FIG. 9, it is also possible to provide a partition plate 414 in the water washing vessel 402 with the water washing rollers 404, 406 provided with two each corresponding guiding rollers 416, 418, 420, 422. Further, as shown in FIG. 10, it is also possible to supply fresh washing water to the second stage vessel, send the overflow from the second stage to the first stage, and the overflow from the first stage is discharged to have the water level of the second stage higher than that of the first stage with respect to the partition plate 414 in a so-called cascade method.

(Modified embodiment of the water washing portion 2)

Figure 11:
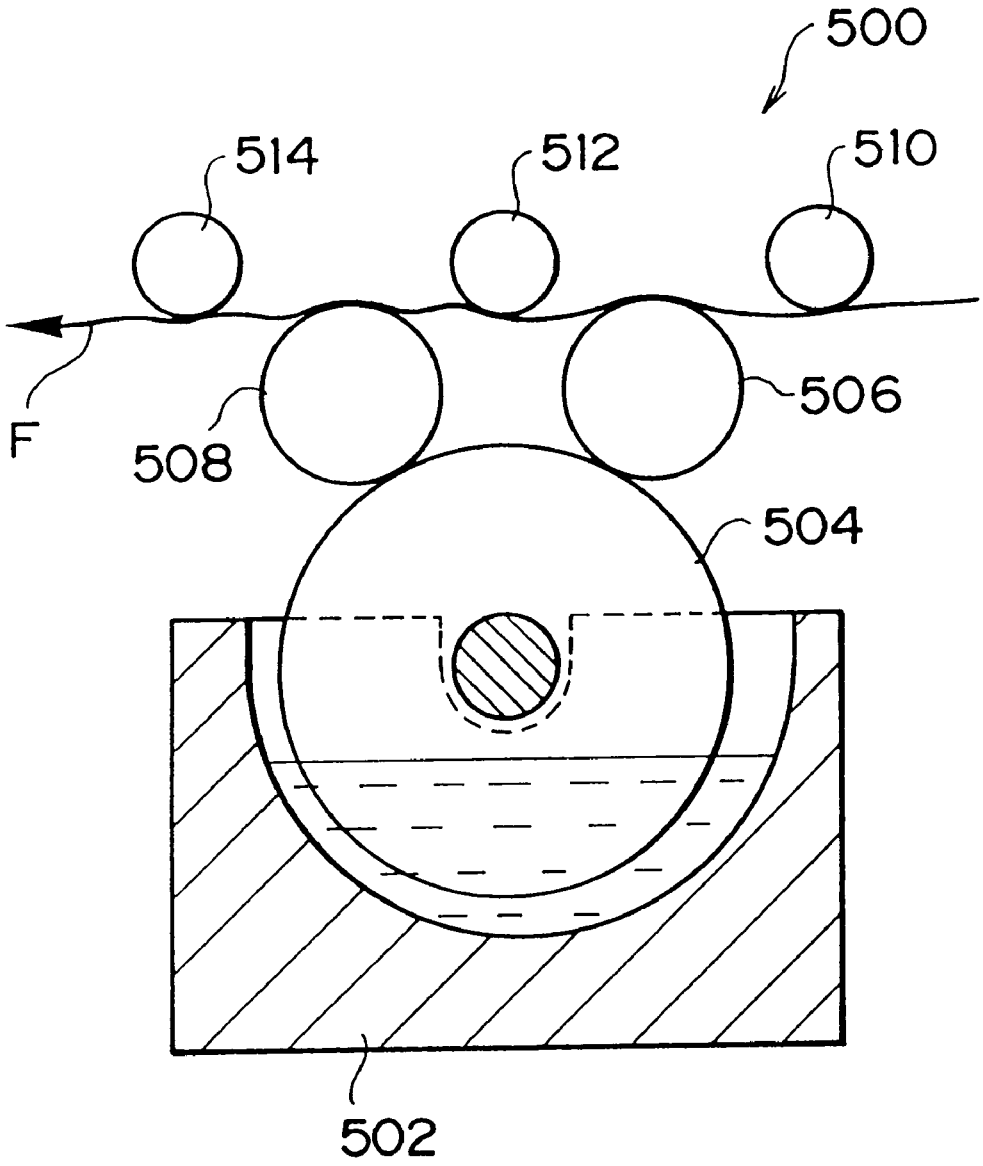
FIG. 11 is a front view of a modified embodiment of the water washing portion.

FIG. 11 shows a second modified embodiment of the water washing portion of the embodiment.

A water washing portion 500 of the second modified embodiment comprises one take-up roller 504 provided in a water washing vessel 502, and two water washing rollers 506, 508 arranged so as to contact to the take-up roller 504. Three guiding rollers 510, 512, 514 are provided corresponding to the two water washing rollers 506, 508 alternately so that the two stage water washing can be conducted according to the film F transportation.

Since the take-up roller 504 is provided between the water washing vessel 202 in conducting the two stage water washing by the use of the two water washing rollers 216, the length of the water washing vessel 502 in the film transporting direction can be shortened.

(Modified embodiment of the water washing portion 3)

Figure 12:
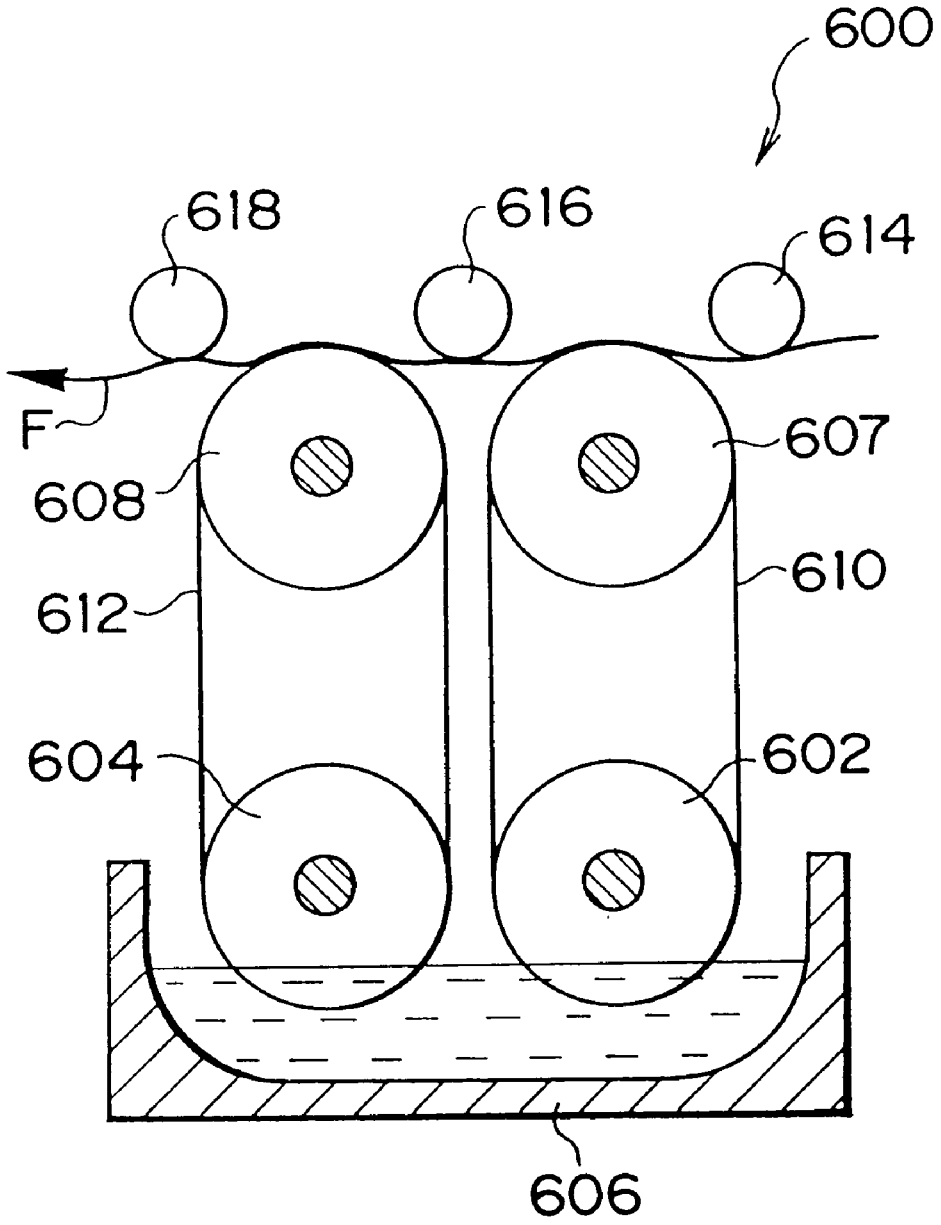
FIG. 12 is a front view of a modified embodiment of the water washing portion.

FIG. 12 shows a third modified embodiment of the water washing portion of the embodiment.

A water washing portion 600 of the third modified embodiment comprises two take-up rollers 602, 604, provided in a water washing vessel 600 partially soaked to the washing water in the water washing vessel 606, and two driving rollers 607, 608 are provided immediately above each of the take-up rollers 602, 604, with water washing belt 610, 612 wound around, respectively.

The surface of the belts 610, 612 is mirror finished so that the belts 610, 612 can take up the washing water according to the rotation of the driving rollers 606, 608. Guiding rollers 614, 616, 618 are provided above the driving rollers 606, 608 alternately.

Since the washing water is taken up by the belts 610, 612, the entirety of the take-up rollers 602, 604 can be stored in the washing water so that the unit take-up amount can be increased. By the increase of the unit take-up amount of the washing water, the water washing effect can be improved.

Figure 13:
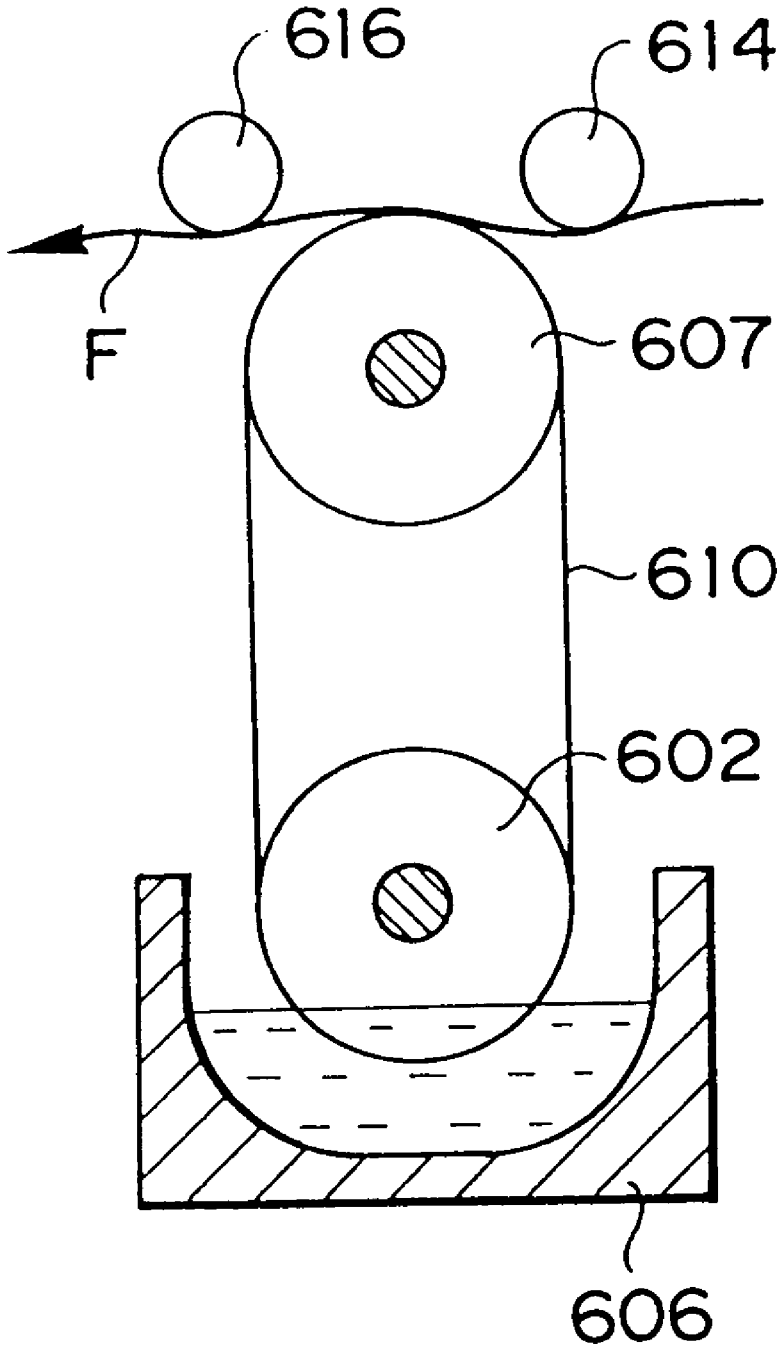
FIG. 13 is a front view of a modified embodiment of the water washing portion.

Although the two stage water washing is conducted in the third modified embodiment, it can have a one stage water washing configuration as shown in FIG. 13.

(Modified embodiment of the water washing portion 4)

Figure 14:
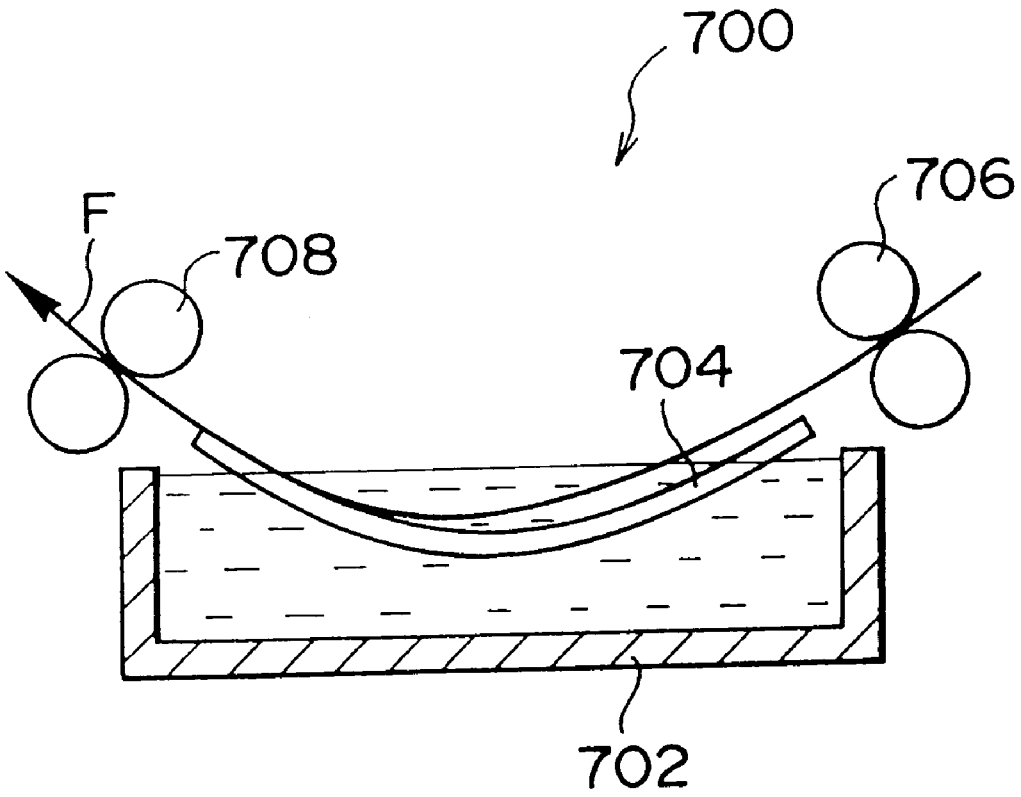
FIG. 14 is a front view of a modified embodiment of the water washing portion.

FIG. 14 shows a fourth modified embodiment of the water washing portion of the embodiment.

Although the water washing portions 400, 500, 600 in the above mentioned embodiment and first to third modified embodiments have a configuration to utilize squeezing at the same time, the fourth modified embodiment has a configuration having water washing and squeezing completely independent to each other.

That is, as shown in FIG. 14, a water washing portion 700 comprises a washing water tank 702. The washing water tank 702 is formed to have a plate-like shape and filled with washing water. Furthermore, an arc-like guide 704 is provided in the washing water tank 702 for soaking the film F in the water.

The film can be transported in a substantially arc-like manner along the guide 704 to be washed with water.

A pair of rollers 706 and a pair of rollers 708 are provided on the upstream side and the downstream side with respect to the washing water tank 702. The downstream side pair of rollers 708 function as squeeze rollers eliminating excessive water from the film F .

Such a water washing configuration is applied also to the water applying portion 42 of the embodiment. Since this is a configuration where the film F is soaked, that is, immersed, the water content of the film F will be higher than the water washing in the water washing portion in the embodiment even after squeezing, however, it has the advantage of having a simple configuration.

(Modified embodiment of the water washing portion 5)

Figure 15:
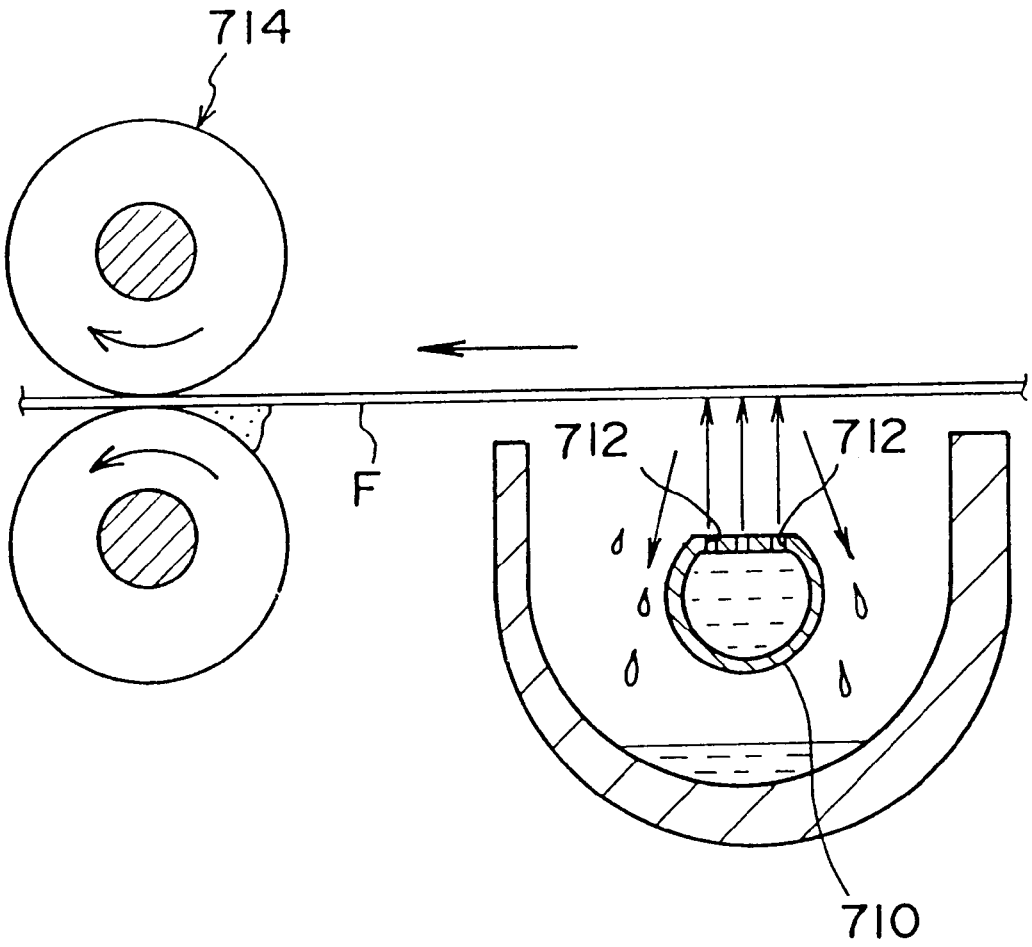
FIG. 15 is a front view of a modified embodiment of the water washing portion.

FIG. 15 shows a fifth modified embodiment of the water washing portion of the embodiment.

As in the fourth modified embodiment, the fifth modified embodiment has a configuration having water washing and squeezing completely independent of each other.

That is, as shown in FIG. 15, a pipe 710 is provided in the film width direction below the transporting path of the film F. The pipe 710 is provided with a plurality of small holes 712 along the axial direction thereon so that washing water can jet out of the small holes 712 by the internal pressure built up by the supply of washing water to the pipe 710.

The jetted washing water is applied to the film F. The lower surface of the film F is washed by the jetting pressure.

A pair of transporting rollers 714 are provided on the downstream side with respect to the pipe 710 for holding the film F. The downstream side roller of the transporting rollers 714 is mirror finished so as to prevent irregular water washing or damage to the surface of the water washed film F. The film F is squeezed by being held by the transporting rollers 714.

Although the film F is transported horizontally in the embodiment and the first to fifth modified embodiments, it can be transported obliquely, downward, upward, or by a combination thereof.

(Modified embodiment of the drying portion 1)

Figure 16:
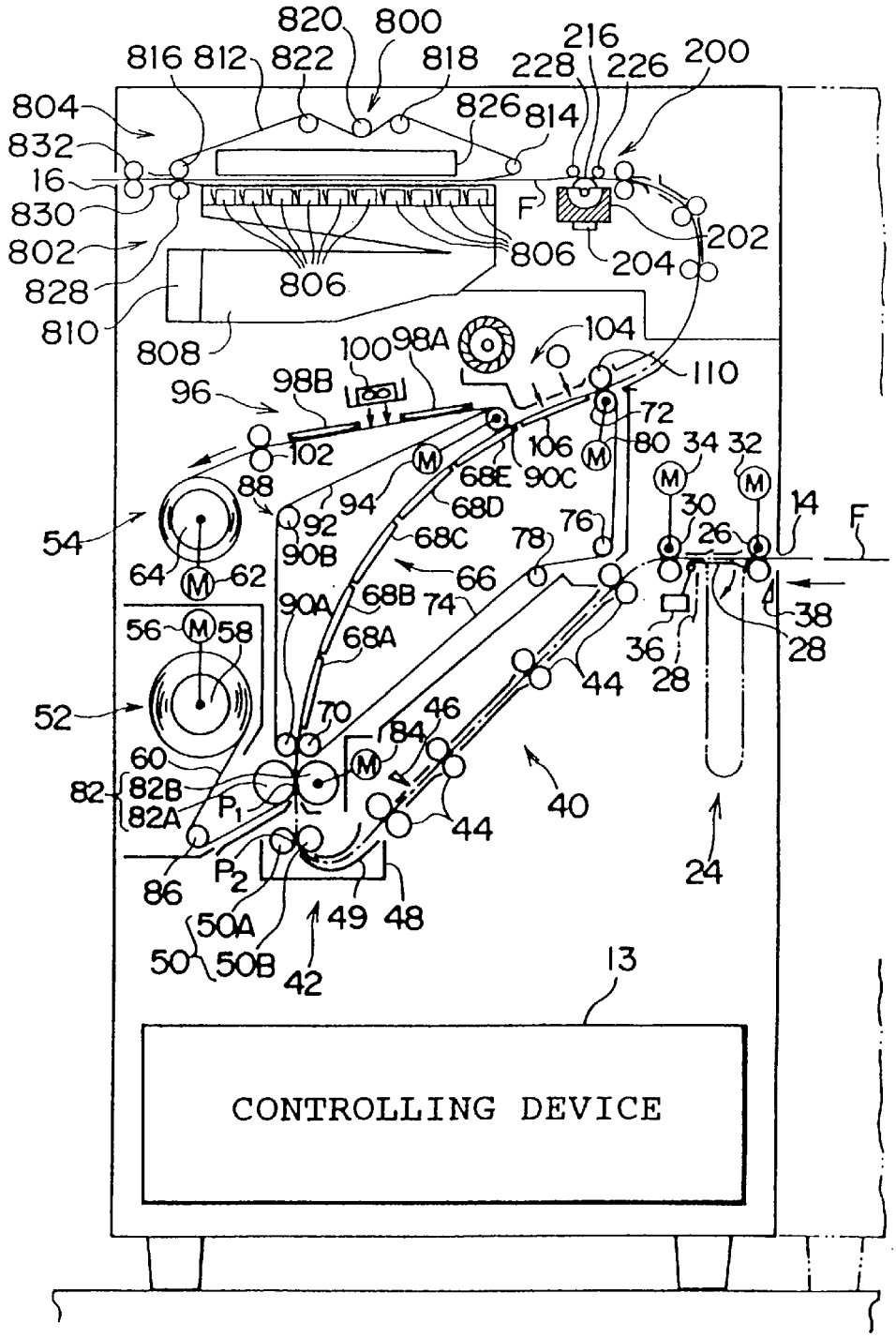
FIG. 16 is a front view of a modified embodiment of the drying portion.

FIG. 16 shows a first modified embodiment of the drying portion of the embodiment.

As shown in FIG. 16, a drying portion 800 has a hot air generating portion 802 in the lower part and a film guiding portion 804 in the upper part with respect to the substantially linear transporting path space of the film F.

In the hot air generating portion 802, a plurality of narrow box-like hot air discharging portions 806 with the longitudinal direction arranged in the film transporting width direction are provided in the film transporting direction. A slit hole is provided along the film width direction respectively in the hot air discharging portions 806 so that the hot air can be blown out by applying pressure to the inside of the hot air discharging portions 806.

A communicating opening with a hot air guiding duct 808 provided below the hot air discharging portions 806 is provided for the end portion of each of the hot air discharging portions 806. Hot air supplied from a blower 810 with pressure and heated by the heater (not illustrated) is supplied to the hot air guiding duct 808. The capacity of the hot air guiding duct 808 becomes gradually smaller toward the downstream side of the drying portion 800 so as to have the constant pressure for sending to the hot air discharging portions 806. Accordingly, the hot air can be blown out with a substantially constant air amount from the most upstream side to the most downstream side of the drying portion 800.

On the other hand, a transporting guiding belt 812 is provided in the film guiding portion 804. The transporting guiding belt 812 is wound around five rollers 814, 816, 818, 820, 822 provided on the upstream side, the downstream side with respect to the drying portion 800 and above the drying portion 800. Among these rollers, by the rollers 814, 816 at the upstream side and the downstream side with respect to the drying portion 800, the transporting guiding belt 812 is maintained to be in the substantially horizontal state above the transporting path of the film F. Further, the roller 818 above the drying portion 800 has a function as a driving roller so that the transporting guiding belt 812 can transport at a constant rate by the rotation of the roller 818 as the driving source driven by a driving means (not illustrated).

The roller 820 at the center above the drying portion 800 has a function as a tension adjusting roller and it can move in a direction perpendicular to the axis. Therefore, by the movement of the roller 820 in the direction perpendicular to the axis, the tension of the transporting guiding belt 812 can be adjusted.

Figure 17B:
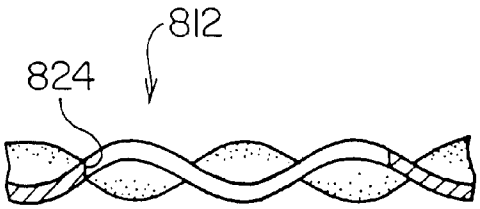
FIG. 17(B) is a cross-sectional view taken on the line 17B—17B of FIG. 17(A).
Figure 17A:
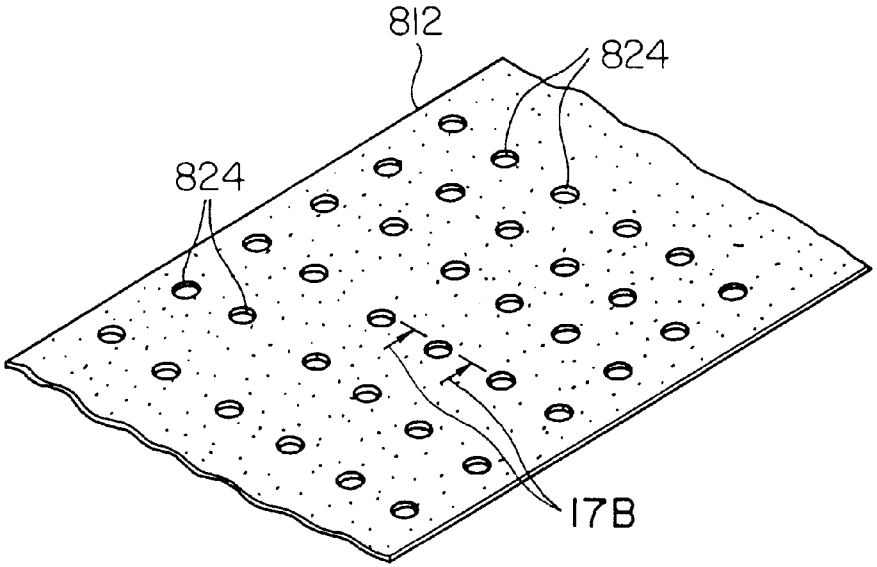
FIG. 17(A) is a perspective view showing the shape of a belt to be used in the modified embodiment of FIG. 16.

As shown in FIGS. 17(A) and 17(B), the external surface of the transporting guiding belt 812 has a grained surface having a sine wave-like rugged shape. The level difference between the projection and the dent here is 0.1 to 0.2 mm. The distance between the projections (or the dents) is 1 mm to 2 mm.

Further, a plurality of round holes 824 are provided in the transporting guiding belt 812. The round holes 824 are provided with a 30 mm interval in the longitudinal direction (transporting direction of the film F) and a 20 mm interval in the lateral direction (width direction of the film F).

A suction means 826 is provided inside the loop formed by the transporting guiding belt 812. Since the suction opening of the suction means 826 is toward the transporting direction of the film F, the round holes 824 of the transporting guiding belt 812 can serve as the suction holes.

The film F transported to the drying portion 800 can be transported at a constant rate by being pushed up to the transporting guiding belt 812 side by the hot air from the hot air discharging portion 806 as well as by being vacuumed by the round holes 824. During the transportation, the lower surface (surface washed with water) can be in the uncontacted state.

The film F cannot fall off during the transportation by being vacuumed, resulting in the surface washed with water coming in contact with the hot air generating portion 802.

However, usually the vacuuming force in the vicinity of the round holes 824 is strong but the vacuuming force in the other area is weak so that a vacuum mark is sometimes left due to the vacuuming force difference.

Since the transporting guiding belt 812 has a grained surface so that the film F can be supported at a plurality of points, the vacuuming force difference between the vicinity of the round holes 824 and the other area can be eliminated so that the generation of the vacuuming mark can be prevented.

A pair of transporting rollers 828 (the upper roller also serves as the roller where the above-mentioned transporting guiding belt 812 is wound around), a guiding plate 830, and a pair of discharging rollers 832 are provided at the most downstream side of the drying portion 800. The film F after drying is discharged from the drying portion 800 while being held by the transporting rollers 828 and guided by the guiding plate 830 to be discharged from a discharging opening 16 by the discharging rollers 832.

Effects of the drying portion 800 of the first modified embodiment will be explained hereinafter.

In the drying portion 800, the film F is pushed up toward the transporting guiding belt 812 of the film guiding portion 804 by the hot air from the hot air discharging portion 806. The transporting guiding belt 812 rotates at a constant rate. The pushed up film F is transported at a constant rate by the transporting force of the transporting guiding belt 812 and is gradually dried. Furthermore, in addition to the pushing up, since the film F is vacuumed with the round holes 824 provided in the transporting guiding belt 812 serving as the suction holes by the suction means 826, the lower surface (the surface washed with water) of the film F can be maintained securely in the uncontacted state.

Since the transporting guiding belt 812 has a grained surface to supported the film F at a plurality of points, the vacuuming force difference between the vicinity of the round holes 824 and the other area can be reduced so that problems such as generation of the vacuuming mark can be prevented.

(Modified embodiment of the drying portion 2)

Figure 18:
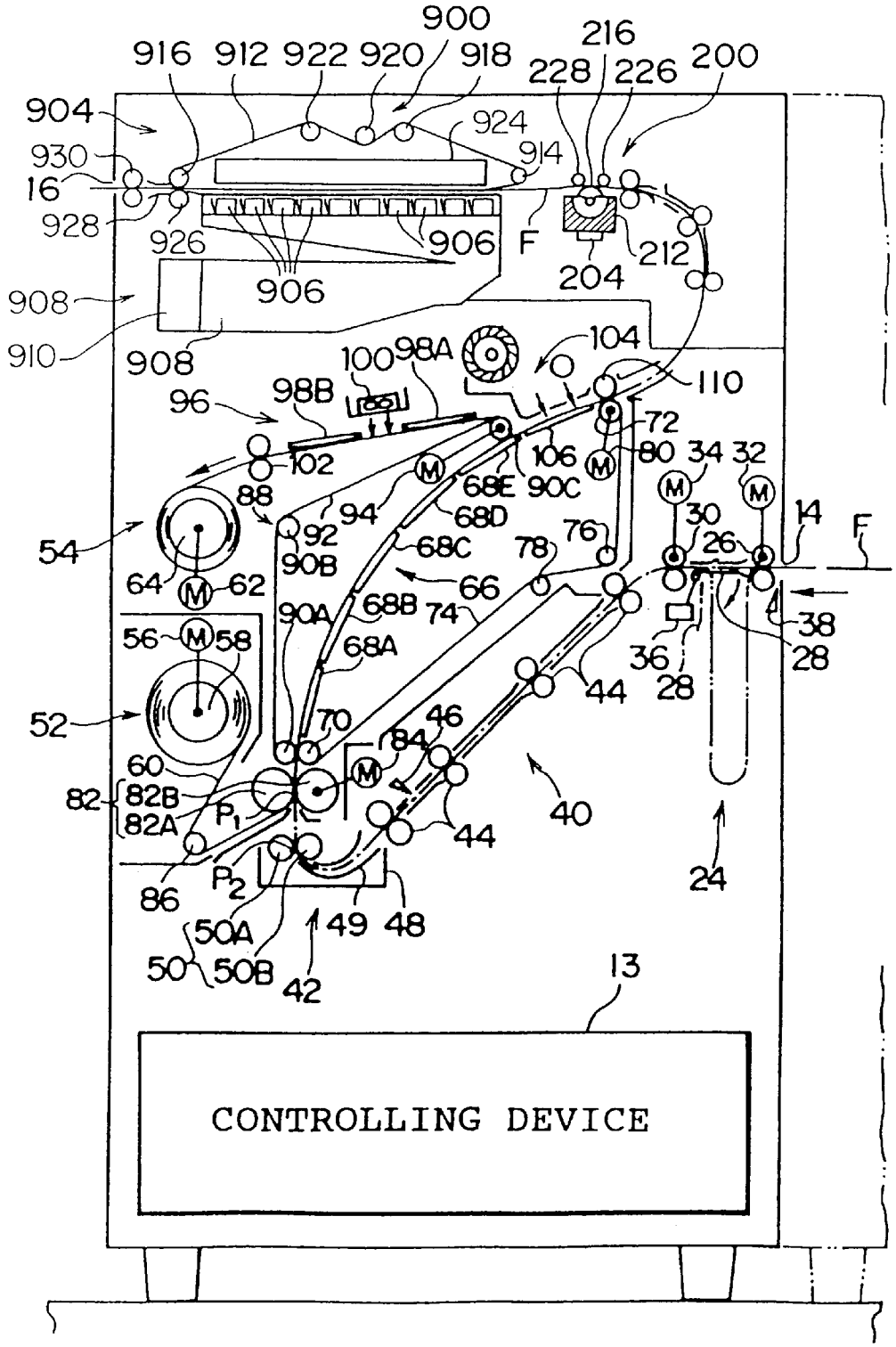
FIG. 18 is a front view of a modified embodiment of the drying portion.

FIG. 18 shows a second modified embodiment of the drying portion of the embodiment.

As shown in FIG. 18, the drying portion 900 has a hot air generating portion 902 in the lower part and a film guiding portion 904 in the upper part with respect to the substantially linear transporting path space of the film F.

In the hot air generating portion 902, a plurality of narrow box-like hot air discharging portions 906 with the longitudinal direction arranged in the film transporting width direction are provided in the film transporting direction. A slit hole is provided along the film width direction respectively in the hot air discharging portions 906 so that the hot air can be blown out by applying pressure to the inside of the hot air discharging portions 906.

A communicating opening with a hot air guiding duct 908 provided below the hot air discharging portions 906 is provided for the end portion of each of the hot air discharging portions 906. Hot air supplied from a blower 910 with pressure and heated by the heater (not illustrated) is supplied to the hot air guiding duct 908. The capacity of the hot air guiding duct 908 becomes gradually smaller toward the downstream side of the drying portion 900 so as to have the constant pressure for sending to the hot air discharging portions 906. Accordingly, the hot air can be blown out with a substantially constant air amount from the most upstream side to the most downstream side of the drying portion 900.

On the other hand, a transporting guiding belt 912 is provided in the film guiding portion 904. The transporting guiding belt 912 is wound around five rollers 914, 916, 918, 920, 922 provided on the upstream side, the downstream side with respect to the drying portion 900 and above the drying portion 900. Among these rollers, by the rollers 914, 916 at the upstream side and the downstream side with respect to the drying portion 900, the transporting guiding belt 912 is maintained to be in a substantially horizontal state above the transporting path of the film F. Further, the roller 918 above the drying portion 900 functions as a driving roller so that the transporting guiding belt 912 can transport at a constant rate by the rotation of the roller 918 as the driving source driven by a driving means (not illustrated).

The roller 920 at the center above the drying portion 900 has a function as a tension adjusting roller and it can move in the direction perpendicular to the axis. Therefore, by the movement of the roller 920 in the direction perpendicular to the axis, the tension of the transporting guiding belt 912 can be adjusted.

Figure 19:
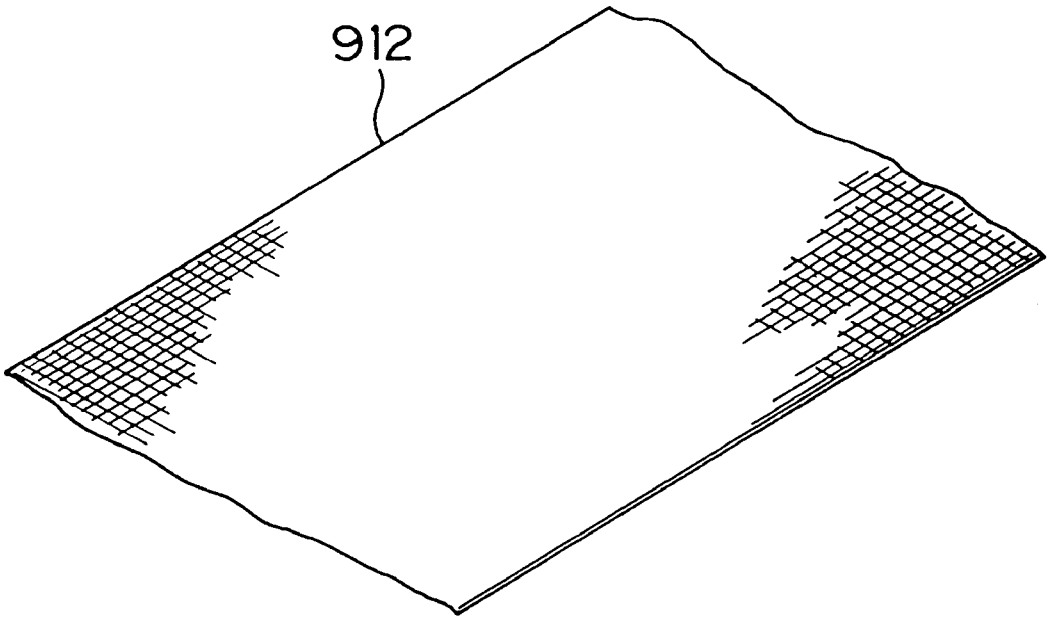
FIG. 19 is a perspective view showing the shape of a belt to be used in the modified embodiment of FIG. 18.

As shown in FIG. 19, the transporting guiding belt 912 is made of a mesh belt. Therefore, fine through holes are provided in the weave textures and the surface thereof is uniformly rough.

A suction means 924 is provided inside the loop formed by the transporting guiding belt 912. Since the suction opening of the suction means 924 is toward the transporting direction of the film F, the fine through holes of the transporting guiding belt 912 can serve as the suction holes.

The film F transported to the drying portion 900 can be transported at a constant rate by being pushed up to the transporting guiding belt 912 side by the hot air from the hot air discharging portion 906 as well as by being vacuumed by the fine through holes. During the transportation, the lower surface (surface washed with water) can be in the uncontacted state.

The film F cannot fall off during the transportation by being vacuumed, resulting in the surface washed with water coming in contact with the hot air generating portion 902. However, if the surface of the transporting guiding belt 912 is smooth, usually the vacuuming force in the vicinity of the suction holes is strong but the vacuuming force in the other area is weak so that a vacuum mark is sometimes left due to the vacuuming force difference.

Since the transporting guiding belt 912 is made of a mesh with a uniform roughness, the vacuuming force difference between the vicinity of the fine through holes (vacuuming holes) and the other area can be eliminated so that the generation of the vacuuming mark can be prevented.

A pair of transporting rollers 926 (the upper roller also serves as the roller where the above-mentioned transporting guiding belt 912 is wound around), a guiding plate 928, and a pair of discharging rollers 930 are provided at the most downstream side of the drying portion 900. The film F after drying is discharged from the drying portion 900 while being held by the transporting rollers 926 and guided by the guiding plate 928 to be discharged from a discharging opening 16 by the discharging rollers 930.

Effects of the drying portion 900 of the second modified embodiment will be explained hereinafter.

In the drying portion 900, the film F is pushed up toward the transporting guiding belt 912 of the film guiding portion 902 by the hot air from the hot air discharging portion 906. The transporting guiding belt 912 rotates at a constant rate. The pushed up film F is transported at a constant rate by the transporting force of the transporting guiding belt 912 and is gradually dried. Furthermore, in addition to the pushing up, since the film F is vacuumed with the fine through holes provided by the mesh in the transporting guiding belt 912 serving as the suction holes by the suction means 924, the lower surface (the surface washed with water) of the film F can be maintained securely in the uncontacted state.

Since the transporting guiding belt 912 is made of a mesh and the surface is uniformly rough so that the film F is supported by the portion along the weave, the vacuuming force difference between the vicinity of the fine through holes and the other area can be reduced so that problems such as generation of the vacuuming mark can be prevented.

As heretofore mentioned, in the developing processing apparatus 10 for heat developing processing using a processing sheet 60, by setting the temperature of the center part of the hot plates 68A to 68E provided in the heat developing portion 66 at a temperature appropriate for the heat developing processing and the temperature of both end parts higher than the center part by a predetermined temperature, the attached film F and processing sheet 60 can be transported along the surface of the hot plates 68A to 68E without generating wrinkles in the processing sheet 60 in a securely adhered state for heat developing processing so that a preferable image can be formed on the film F.

Although water as the solvent for image formation is applied on the film F in the embodiment, it is not limited thereto. For example, it can be applied onto the processing sheet 60, or can be applied onto both film F and processing sheet 60.

As heretofore mentioned, the present invention has an excellent effect in that only the surface where washing is necessary can be washed with a simple configuration.

In addition to the above-mentioned effect, an effect of eliminating a high humidity adhesion property of the heat developing photosensitive material after the heat developing processing can be provided regardless of the degree of the humidity.

Furthermore, in addition to the above-mentioned effects, an effect of drying a wet sheet material without coming into contact with a transporting system and transporting thereof in a predetermined direction can be provided with a simple configuration.

What is claimed is:

1. A cleaning device for cleaning one side of a sheet material, comprising:

a transporting means for transporting the sheet material substantially horizontally;

a saucer for storing a cleaning liquid;

at least one cleaning roller of at least one cleaning roller assembly stored in said saucer, each of said at least one cleaning roller having a part lower than a rotation axis partially soaked in the cleaning liquid;

a plurality of guiding members positioned substantially above said cleaning roller assembly arranged respectively on the upstream side and the downstream side with respect to each of said at least one cleaning roller assembly for guiding the sheet material transported by said transporting means such that said plurality of guiding members contact with each of said at least one cleaning roller assembly near an uppermost point thereof, and a driving means for rotating each of said at least one cleaning roller assembly at an extremely high linear velocity with respect to the transporting rate of the sheet material by said transporting means for taking out the cleaning liquid by respective roller surfaces such that a swirling flow for cleaning is generated in front of a contacting portion proximate said uppermost point, wherein lowermost points of said plurality of guiding members are disposed slightly lower than an uppermost point of each of said at least one cleaning roller assembly so that the lowermost points of said plurality of guiding members press on an upper side of the sheet material being transported while each of said at least one cleaning roller assembly presses a lower side of the sheet material being transported such that the cleaning liquid's swirling flow is intercepted in front of each of said at least one cleaning roller.

2. The cleaning device according to claim 1, wherein said saucer comprises a member having a high heat conductivity so that the cleaning liquid can be heated or the warmth thereof can be kept by heating the saucer itself.

3. The cleaning device according to claim 2, wherein a supply path is provided in said saucer for storing the cleaning liquid so that the cleaning liquid is heated by passing through the supply path owing to the heat exchange.

4. A cleaning device to be used in a developing processing apparatus for heat development of a silver halide photosensitive material where an image is exposed and a processing sheet containing a chemical for forming an image on the silver halide photosensitive material in the presence of a solvent for image formation, wherein a cleaning portion is provided for cleaning the developed surface of the silver halide photosensitive material after said heat development with a cleaning liquid.

5. A cleaning device to be used in a developing processing apparatus for heat development of a silver halide photosensitive material where an image is exposed and a processing sheet containing a chemical for forming an image on the silver halide photosensitive material in the presence of a solvent for image formation, comprising:

a cleaning portion for cleaning at least the developed surface of the silver halide photosensitive material after said heat development with a cleaning liquid, and a squeeze portion for wiping off the cleaning liquid attached to the silver halide photosensitive material after cleaning by the cleaning portion.

6. The cleaning device to be used in a developing processing apparatus according to claim 5, said cleaning portion comprising:

a cleaning tank for storing the cleaning liquid, and a guiding means for guiding the silver halide photosensitive material into the cleaning tank so as to be soaked in the cleaning liquid for a predetermined time according to the transportation.

7. The cleaning device to be used in a developing processing apparatus according to claim 5, said cleaning portion comprising:

a cleaning liquid jetting pipe having a plurality of small holes toward the surface to be developed, and a pressure supply means for supplying the cleaning liquid to said cleaning liquid jetting pipe with pressure, wherein said jetting pipe is provided at the surface to be developed side in the transporting path of said silver halide photosensitive material.

8. A drying device for drying a sheet material having one surface wetter than the other, comprising:

a single hot air discharging means for blowing hot air towards the sheet material provided proximate the wetter surface side of the sheet material; and a transporting means for transporting said sheet material in a predetermined direction, provided opposite the wetter surface side.

9. The drying device according to claim 8, wherein said transporting means comprises a plurality of rollers provided along the transporting path of said sheet material, and a motor for rotating the rollers.

10. A drying device to be used in a developing processing apparatus for heat development of a silver halide photosensitive material where an image is exposed and a processing sheet containing a chemical for forming an image on the silver halide photosensitive material in the presence of a solvent for image formation, comprising:

a drying portion for drying the wet surface to be developed of the silver halide photosensitive material after cleaning without coming into contact with the transporting system.

11. A drying device for drying a sheet material having one surface wetter than the other, comprising:

a hot air discharging means for blowing hot air onto the sheet material provided at the wetter surface side of the sheet material;

a belt provided along the transporting direction of said sheet material at the other less wet surface side of said sheet material; and a transporting means for transporting the sheet material in a predetermined direction by moving said belt in the sheet material transporting direction.

12. A drying device to be used in a developing processing apparatus for heat development of a silver halide photosensitive material where an image is exposed and a processing sheet containing a chemical for forming an image on the silver halide photosensitive material in the presence of a solvent for image formation, comprising:

a cleaning means for cleaning at least the heat developed surface of said silver halide photosensitive material after the heat development; and a drying means for drying mainly the heat developed surface of the silver halide photosensitive material moistened by cleaning by said cleaning means, wherein said drying means comprises a hot air discharging means provided at the wetter heat developed surface side of said silver halide photosensitive material moistened by cleaning by said cleaning means for blowing hot air to the silver halide photosensitive material, a belt provided along the transporting direction of said silver halide photosensitive material at the other non-heat developed less wet surface side of said silver halide photosensitive material, and a transporting means for transporting said silver halide photosensitive material in a predetermined direction by moving said belt in the silver halide photosensitive material transporting direction while supporting the non-heat developed surface of the silver halide photosensitive material.

13. A cleaning device for cleaning one side of a sheet material, comprising:

a transporting means for transporting the sheet material substantially horizontally;

a saucer for storing a cleaning liquid;

a cleaning roller stored in said saucer, with the part lower than the rotation axis partially soaked in the cleaning liquid;

guiding members arranged respectively on the upstream side and the downstream side with respect to said cleaning roller for guiding the sheet material transported by said transporting means such that it contacts with said cleaning roller at the uppermost point thereof, and a driving means for rotating said cleaning roller at an extremely high linear velocity with respect to the transporting rate of the sheet material by said transporting means for taking out the cleaning liquid by the roller surface such that a swirling flow for cleaning is generated in front of the contacting portion at said uppermost point, wherein said saucer comprises a member having a high heat conductivity so that the cleaning liquid can be heated or the warmth thereof can be kept by heating the saucer itself.

14. The cleaning device according to claim 13, wherein a supply path is provided in said saucer for storing the cleaning liquid so that the cleaning liquid is heated by passing through the supply path owing to the heat exchange.

* * * * *